US011371772B2

(12) United States Patent
Oh

(10) Patent No.: US 11,371,772 B2
(45) Date of Patent: Jun. 28, 2022

(54) REFRIGERATOR

(71) Applicant: LG ELECTRONICS INC., Seoul (KR)

(72) Inventor: Changseok Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/140,985

(22) Filed: Jan. 4, 2021

(65) Prior Publication Data

US 2021/0123668 A1 Apr. 29, 2021

Related U.S. Application Data

(63) Continuation of application No. 16/545,716, filed on Aug. 20, 2019, now Pat. No. 10,928,123.

(30) Foreign Application Priority Data

Aug. 29, 2018 (KR) ..... 10-2018-0102319

(51) Int. Cl.
*F25D 25/02* (2006.01)
*A47B 88/497* (2017.01)
*A47B 88/437* (2017.01)

(52) U.S. Cl.
CPC ..... *F25D 25/025* (2013.01); *A47B 88/437* (2017.01); *A47B 88/497* (2017.01); *F25D 2325/00* (2013.01)

(58) Field of Classification Search
CPC .... F25D 25/025; A47B 88/437; A47B 88/497
(Continued)

(56) References Cited

U.S. PATENT DOCUMENTS 788,856 A 5/1905 Stafford
4,173,378 A * 11/1979 Hanson ..... F25D 23/069 312/270.3

(Continued)

FOREIGN PATENT DOCUMENTS

| | | |
|---|---|---|
| EP | 3 358 282 | 8/2018 |
| KR | 10-2017-0138321 | 12/2017 |
| WO | WO 2014/201615 | 12/2014 |

OTHER PUBLICATIONS

European Search Report dated Jan. 30, 2020 issued in EP Application No. 19193835.6.

(Continued)

*Primary Examiner* — James O Hansen
(74) *Attorney, Agent, or Firm* — KED & Associates, LLP

(57) ABSTRACT

A refrigerator includes a cabinet including an inner case, and a drawer assembly installed in the inner case. The drawer assembly includes a basket which forms a receiving space and can be pulled in and out of the inner case, a supporter assembly connected to the basket to guide an insertion or withdrawal of the basket, and a cover connected to the supporter assembly to cover or uncover the receiving space. The cover may be movable in a direction opposite to a movement of the basket when the basket is inserted or withdrawn. The basket includes a protrusion configured to engage with or disengage from a notch of a connection member to facilitate or prevent transmission of a movement force of the basket to the cover.

18 Claims, 16 Drawing Sheets

(58) Field of Classification Search
USPC ..... 312/401, 402, 404, 330.1, 331
See application file for complete search history.

(56) References Cited

U.S. PATENT DOCUMENTS

| | | | | |
|---|---|---|---|---|
| 4,732,435 | A * | 3/1988 | Bailey | F25D 25/025 312/311 |
| 8,152,255 | B2 | 4/2012 | Nam | |
| 8,226,182 | B2 | 7/2012 | Park | |
| 8,376,481 | B2 * | 2/2013 | Lee | F25D 25/025 312/402 |
| 8,936,332 | B2 | 1/2015 | Park | |
| 2005/0145704 | A1 | 7/2005 | Hwang | |
| 2007/0011950 | A1 | 1/2007 | Wood | |
| 2007/0262686 | A1 | 11/2007 | Ji | |
| 2008/0265733 | A1 | 10/2008 | Hue | |
| 2011/0219808 | A1 | 9/2011 | Oh | |
| 2018/0028371 | A1 | 10/2018 | Takaishi | |

OTHER PUBLICATIONS

U.S. Office Action dated Jul. 22, 2020 issued in parent U.S. Appl. No. 16/545,716.
U.S. Notice of Allowance dated Oct. 7, 2020 issued in parent U.S. Appl. No. 16/545,716.

* cited by examiner (a)

(b)

(a)

(b)

REFRIGERATOR

CROSS-REFERENCE TO RELATED APPLICATIONS

This application is a Continuation Application of U.S. application Ser. No. 16/545,716, filed on Aug. 20, 2019, which is based on and claims the benefit of priority to Korean Patent Application No. 10-2018-0102319, filed in Korea on Aug. 29, 2018, in the Korean Intellectual Property Office, the entire disclosures of which are herein incorporated by reference.

BACKGROUND

1. Field

The present disclosure relates to a refrigerator.

2. Background

A refrigerator may be a household appliance which can store food in an internal storage space which is shielded by a door at low temperatures, and the refrigerator may store the food in an optimal state by cooling an inside of the storage space using cold air generated by heat exchange with a refrigerant circulating in a refrigeration cycle. Such a refrigerator may be large-sized and multifunctional as dietary life is changed and taste of a user is diversified and the refrigerator which has various storage spaces for the user's convenience and has a convenience device is released.

Korean Patent Laid-Open Publication No. 10-2017-0138321, which is a related art, discloses a refrigerator. The refrigerator of the related art includes a cabinet in which a storage space is formed, a pantry assembly provided in the storage space and forming a receiving space for a separate food, and a shielding member which is provided on the pantry assembly and shields a portion of the upper surface of the pantry assembly.

The pantry assembly includes a pair of support members disposed on both sides of the storage space, a receiving member provided between the pair of support members to pull in and out along the support member, a cover member which shields a portion of an opened upper surface of the receiving member and is moved in a direction opposite to a moving direction of the receiving member by being interlocked with pulling-in and out operations of the receiving member, and a drive unit which is provided on the support member and connects so that the receiving member and the cover member are interlocked with each other.

The drive unit includes a second gear assembly coupled to the receiving member and moved in the same direction as the receiving member when the receiving member is pulled in and out, a first gear member coupled to the cover member and moved in the same direction as the cover member; a connecting gear rotatably provided between the second gear assembly and the first gear assembly and connecting the second gear assembly and the first gear member; and an elastic member for forcing the receiving member to be pulled in in a state where the receiving member and the second gear assembly are coupled. According to the related art, a user has to apply a force greater than the elastic force of the elastic member and the load of the receiving member in order to pull the receiving member.

When the elastic force of the elastic member is increased, while a force by which a user pulls the receiving member is increased to make it difficult to open the receiving member, the receiving member is easily returned to the original position thereof by the elastic member in a process of pushing the receiving member in order to return the receiving member to an original position thereof. However, in a case where the elastic force of the elastic member is large, there is a disadvantage that the collision noise is large in a process of returning the receiving member to the original position.

On the other hand, when the elastic force of the elastic member is small, a force to pull the receiving member is required to be small. However, there is a disadvantage that the load of the receiving member is larger than the force that the elastic member pulls the receiving member in a process of pushing the receiving member in order to return the receiving member to the original position thereof, so that the receiving member cannot be completely returned to the original position thereof only by the elastic force of the elastic member.

BRIEF DESCRIPTION OF THE DRAWINGS

Embodiments will be described in detail with reference to the following drawings in which like reference numerals refer to like elements, and wherein.

DETAILED DESCRIPTION

Figure 1:
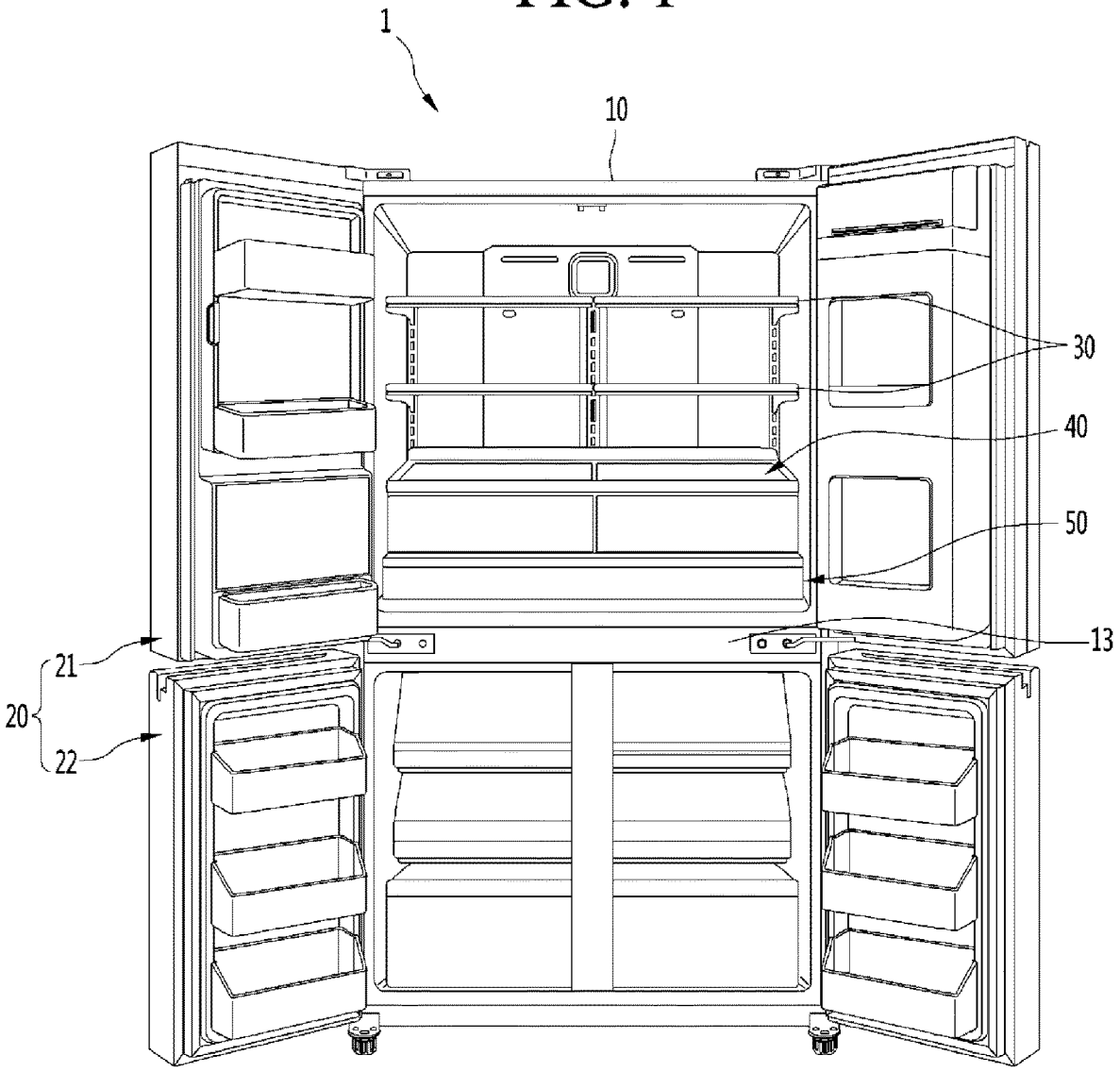
FIG. 1 is a perspective view illustrating a refrigerator in a state where a refrigerator door is opened according to an embodiment of the present disclosure.
Figure 2:
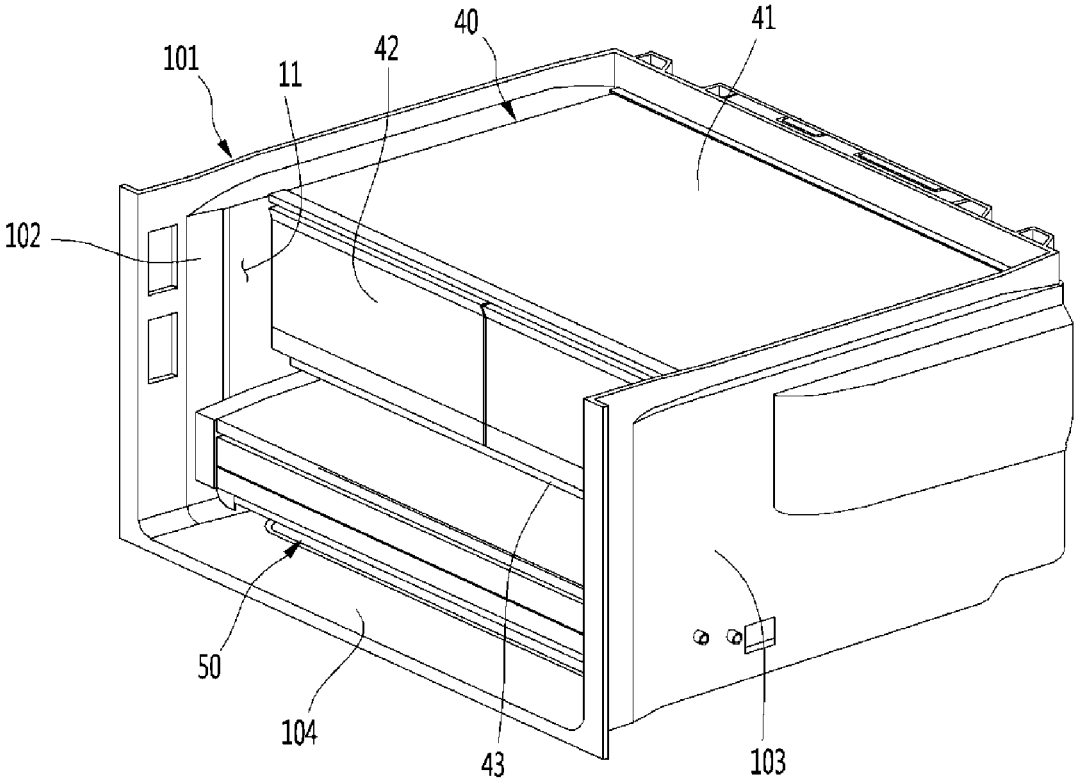
FIG. 2 is a perspective view illustrating a pantry assembly in the refrigerating chamber and an upper drawer assembly.
Figure 3:
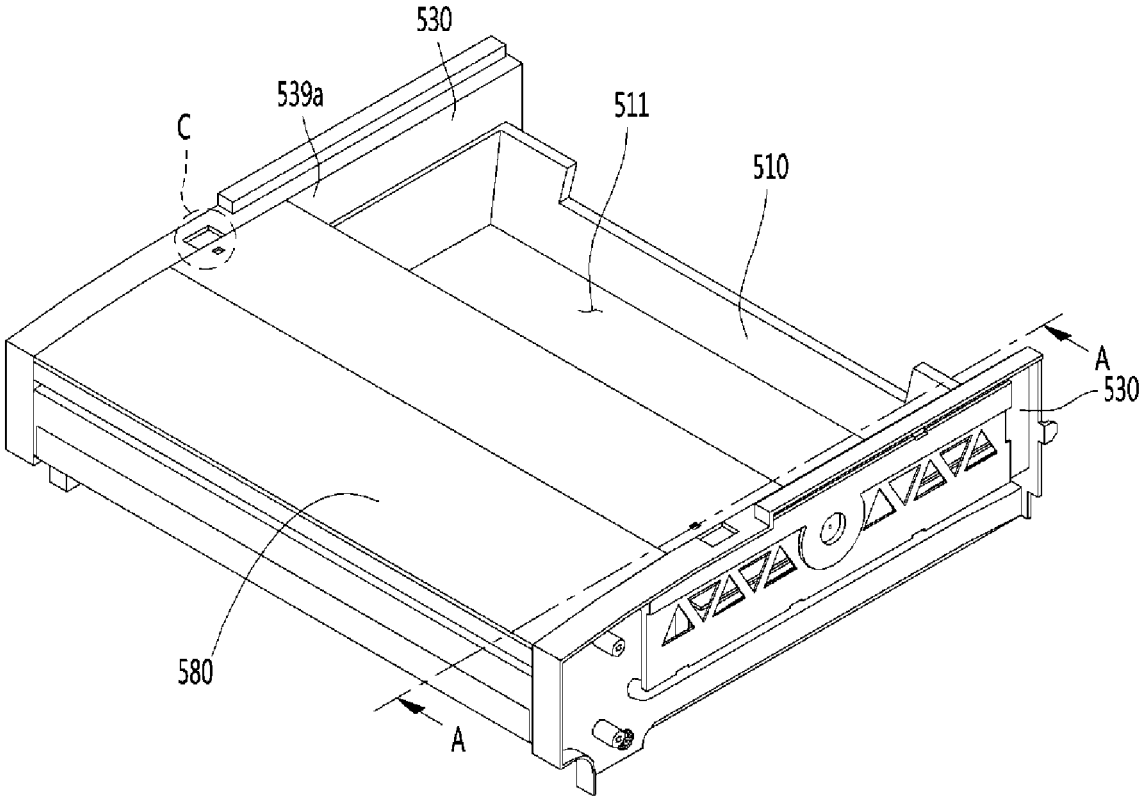
FIG. 3 is a perspective view illustrating the pantry assembly according to an embodiment.

Referring to FIGS. 1 to 3, a refrigerator 1 according to an embodiment of the present disclosure may include a cabinet 10 that forms a storage chamber, and a refrigerator door 20 for opening and closing the cabinet 10. The storage chamber may be partitioned into a refrigerating chamber 11 and a freezing chamber 12 by the partitioning portion (or partition) 13 in the cabinet 10. In FIG. 1, as an example, the freezing chamber 12 is located below the refrigerating chamber 11, but the present disclosure is not limited thereto.

The refrigerator door 20 may include a refrigerating chamber door 21 for opening and closing the refrigerating chamber 11 and a freezing chamber door 22 for opening and closing the freezing chamber 12. Although not limited, a pair of refrigerating chamber doors 21 arranged on the left and right sides may open and close the refrigerating chamber 11.

In addition, a pair of freezing chamber doors 22 arranged on the left and right sides may open and close the freezing chamber 12. The storage chamber may include a pantry assembly (or first drawer assembly) 50 in which a food receiving space is exposed forward by pulling-in and out. In the pantry assembly 50, a receiving space having an area larger than a pulled-out area may be exposed to the outside when the pantry assembly 50 is pulled out.

The position where the pantry assembly 50 is provided is not limited, but the following description will be made about the disposition of the pantry assembly 50 in the refrigerating chamber 11. The pantry assembly 50 may be positioned at the lowermost portion of the refrigerating chamber 11. A width of the pantry assembly 50 may be substantially the same as a width of the refrigerating chamber 11.

The cabinet 10 may include an inner case 101 that forms the refrigerating chamber 11. The inner case 101 may include a pair of side walls 102 and 103 spaced left and right and a bottom wall 104 connecting the pair of side walls 102 and 103. The pantry assembly 50 may be fixed to the pair of side walls 102 and 103.

The pantry assembly 50 may include a receiving member (or basket) 510 forming a receiving space 511, a supporter assembly connected to the receiving member 510 and guiding the pulling-in and out of the receiving member 510, and a cover member (or cover) 580 connected to the supporter assembly and opening and closing the receiving space 511 being interlocked with the basket 510.

The supporter assembly may include a pair of supporters 530 connected to the basket 510 to support the basket 510. The pair of supporters 530 may be installed on each of the pair of side walls 102 and 103.

The cover 580 may cover a portion of the receiving space 511. A second drawer assembly 40 may be positioned above the cover 580. At least one shelf 30 may be provided above the second drawer assembly 40 in the refrigerating chamber 11. Food may be placed on the shelf 30.

The second drawer assembly 40 may include a drawer 42 which forms a receiving space and can be pulled out forward, a drawer supporter 43 which supports a lower side of the drawer 42, and a drawer cover 41 covering the upper side of the drawer 42. The drawer supporter 43 may be fixed to the inner case 101 and may cover a portion of the upper side of the basket 510.

Therefore, in the present embodiment, the cover 580 is a movable cover, and the drawer supporter 43 may be a fixed cover which is kept in a fixed state. In addition, food may be placed on the drawer cover 41, and the drawer cover 41 may function as the shelf 30.

The space which is not covered by the cover member 580 may be covered by the drawer supporter 43.

Figure 4:
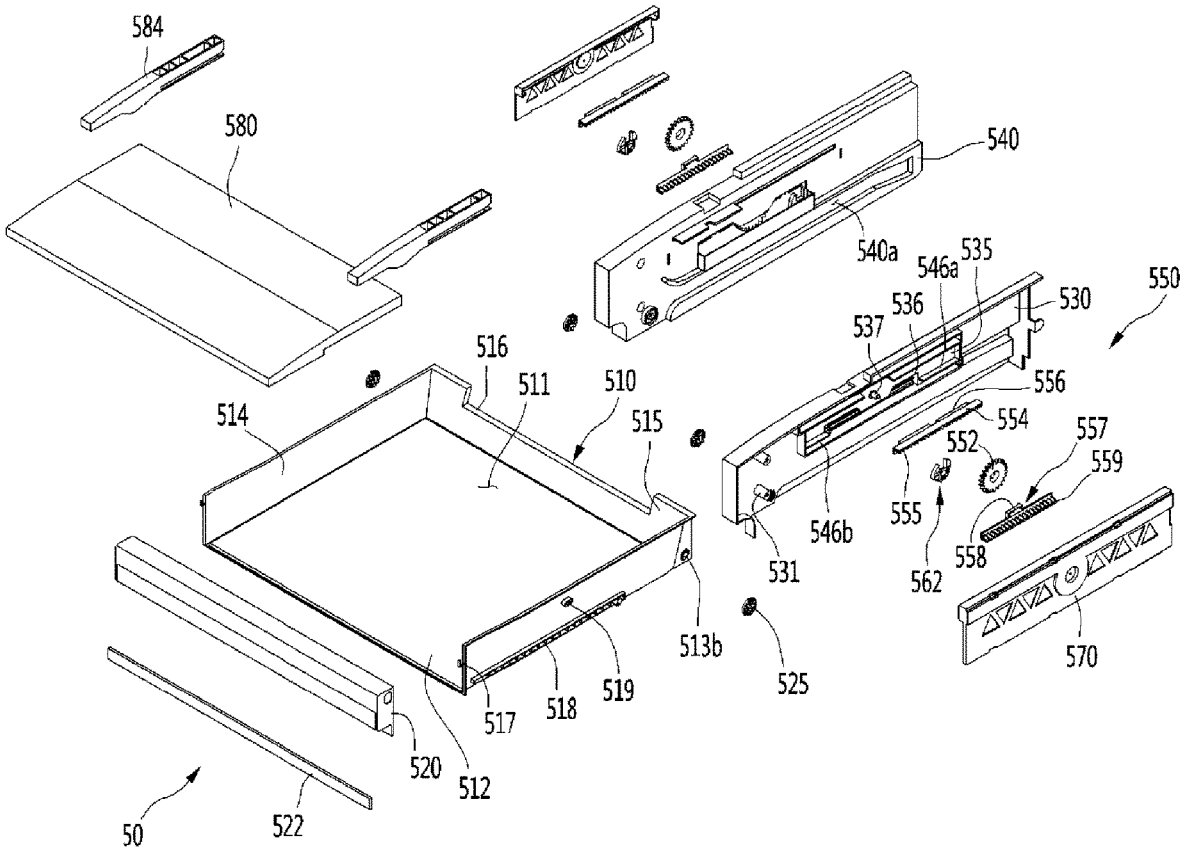
FIG. 4 is an exploded perspective view illustrating the pantry assembly of FIG. 3.

Referring to FIGS. 3 and 4, the basket 510 may form the receiving space 511. The basket 510 may be formed in a rectangular parallelepiped shape having an opened top surface.

The basket 510 may include a bottom wall 512, a pair of side walls 513 and 514 extending upward from both side ends of the bottom wall 512, and a rear wall 515 connecting rear ends of a pair of side walls 513 and 514. The basket 510 may further include a front opening 517 and the front opening 517 may be covered by a front cover 520 coupled to the front surface of the basket 510. A deco cover 522 may be coupled to a lower portion of the front cover 520.

A cool air slot 516 for passing cool air may be formed in the rear wall 515 of the basket 510. The cool air slot 516 may be formed when the upper end of the rear wall 515 is recessed downward.

Each of the pair of side walls 513 and 514 of the basket 510 may include a guide protrusion 518 extending in the front and rear direction. The guide protrusions 518 may extend rearward from the front end portion of each of the side walls 513 and 514 and extend to a position spaced apart from the rear ends of the side walls 513 and 514 by a predetermined distance. The length of the guide protrusion 518 may be determined in consideration of a distance for pulling out the basket 510.

A first roller supporter 513*b* to which the first roller 525 is coupled may be formed on each of the side walls 513 and 514 of the receiving member 510.

The first roller supporter 513*b* may be positioned behind the guide protrusions 518 at the respective side walls 513 and 514. In other words, the first roller supporter 513*b* may be positioned behind the guide protrusion 518 and may be formed on a position adjacent to the rear ends of each of the side walls 513 and 514.

The pair of supporters 530 may support the basket 510 and may guide the sliding of the basket 510. The guide rails 540 for guiding the first roller 525 of the basket 510 may be provided on the surfaces of the pair of supporters 530 facing each other.

The guide rails 540 may protrude from the respective supporters 530 to receive the first rollers 525. At this time, the guide rails 540 may protrude in a direction approaching each other at the respective supporters 530.

The guide rail 540 may include a space 540*a* for receiving the first roller 525. The first roller 525 may move along the guide rail 540 while rotating in the space 540*a*. Each of the side walls 513 and 514 of the basket 510 may include one or more fastening bosses 531 for fastening to the side walls 102 and 103 of the inner case 101.

Each of the side walls 513 and 514 of the basket 510 may include a transmission protrusion 519 for transmitting the moving force of the basket 510 to the cover 580. The transmission protrusions 519 may be positioned above the guide protrusions 518 and may be positioned substantially at a side of the central portion in the front and rear direction of the respective side walls 513 and 514.

When the basket 510 is slid in the first direction in order to pull out the basket 510, the cover 580 may be slid in a second direction which is a direction opposite to the first direction so that the receiving space 511 of the basket 510 is opened. At this time, the cover 580 may be moved by receiving the movement force of the basket 510.

Therefore, the supporter assembly may further include a transmission unit 550 for transmitting the movement force of the basket 510 to the cover 580. The transmission unit 550 may be supported by the supporter 530 and may be connected to the cover 580.

The transmission unit 550 may transmit the moving force of the basket 510 to the cover 580 in some sections in a process of pulling-in of the basket 510, and the moving force of the basket 510 may not be transferred to the cover 580 in some other sections. For example, the transmission unit 550 may transmit the movement force of the basket 510 to the cover 580 until the basket 510 is pulled out by a predetermined distance from the pulling-in completion position.

When the basket 510 is pulled out by a distance larger than the predetermined distance from the pulling-in completion position, the transmission unit 550 may block or prevent the movement force of the basket 510 to the cover 580. Specifically, the transmission unit 550 may include a connection member 562 which may be connected to or engaged with the transmission protrusion 519 of the basket 510, a first rack 557 to which the connection member 562 is rotatably connected, a transmission gear 552 which is connected to the first rack 557, and a second rack 554 which is connected to the transmission gear 552 and coupled to the cover 580. The first rack 557, transmission gear 552, and second rack 554 may alternatively be referred to as a first gear, a second gear, and a third gear, respectively.

The transmission unit 550 may be covered by a unit cover (or cover plate) 570. The cover plate 570 may be coupled to the supporter 530. The cover plate 570 may be positioned in a direction opposite to the guide rail 540 with respect to the supporter 530 to cover the transmission unit 550.

The first rack 557 may include a first rack gear portion (or first rack gear) 559 connected to the transmission gear 552 as a linear rack moving in a linear direction. The gear teeth of the first rack gear 559 may face upward. The first rack 557 may further include a coupling body 558 provided at a substantially central portion of the first rack gear 559 and to which the coupling member 562 is coupled.

The coupling member 562 may be rotatably connected to the coupling body 558. The transmission gear 552 may be a pinion gear, and may be positioned between the first rack 557 and the second rack 554. At this time, the transmission gear 552 may be connected to the first rack gear 559 at the upper side of the first rack gear 559.

This may reduce a lateral thickness in the horizontal direction by the transmission unit 550. As the horizontal thickness of the transmission unit 550 in the lateral direction increases, since the volume of the basket 510 decreases, when the horizontal thickness of the transmission unit 550 may be reduced, the volume reduction amount of the basket 510 can be minimized.

The second rack 554 may be a linear rack which moves in a linear direction and may include a second rack gear portion (or second rack gear) 555 which meshes with the transmission gear 552. The second rack gear 555 may be engaged with the transmission gear 552 at the upper side of the transmission gear 552. This may reduce the horizontal thickness in the lateral direction by the transmission unit 550.

The basket 510 may be positioned on one side of the supporter 530 and a portion of the transmission unit 550 may be positioned on the other side of the supporter 530. This may prevent the transmission unit 550 from being exposed in the process of inserting and withdrawing the basket 510.

Since the basket 510 and the transmission unit 550 may be positioned opposite to each other with respect to the supporter 530, an opening 536 through which the connection member 562 passes may be formed on the supporter 530 so that the transmission protrusion 519 of the basket 510 may be connected to the transmission unit 550.

The opening 536 may extend in the longitudinal direction of the supporter 530. At this time, the longitudinal direction is the front and rear direction of the supporter 530. The supporter 530 may further include a gear shaft 537 for rotatably supporting the transmission gear 552. The gear shaft 537 may be inserted in the center of the transmission gear 552.

A connection frame 584 may be coupled to both sides of the cover 580. The connection frame 584 may include a first connection frame and a second connection frame and may be connected to the transmission unit 550 to receive the movement force of the basket 510 through the transmission unit 550.

The connection frame 584 may prevent the cover 580 from being damaged when the movement force of the basket 510 is received. The cover 580 may be formed in the form of a thin plate. When the cover 580 is directly connected to the transmission unit 550, the cover 580 may be damaged when the movement force is transmitted to the cover 580, but, according to the present embodiment, this phenomenon may be prevented.

Figure 5:
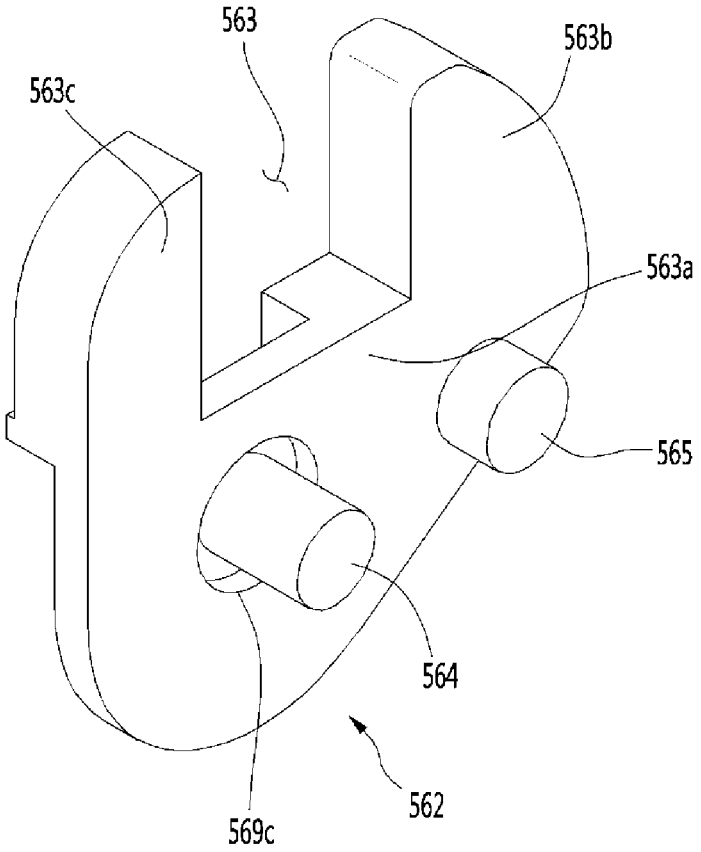
FIGS. 5 and 6 are perspective views illustrating a connection member according to an embodiment.
Figure 6:
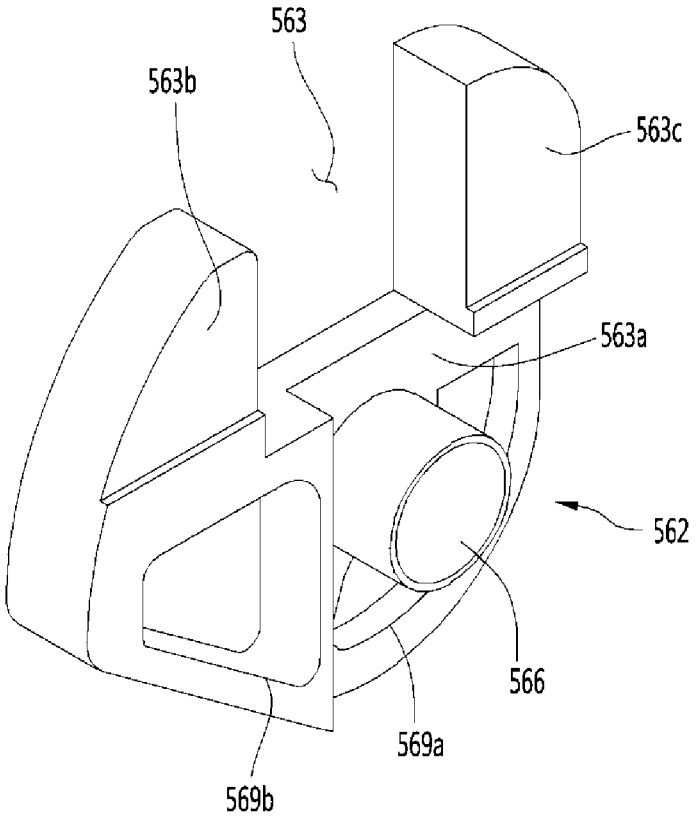
Figure 7:
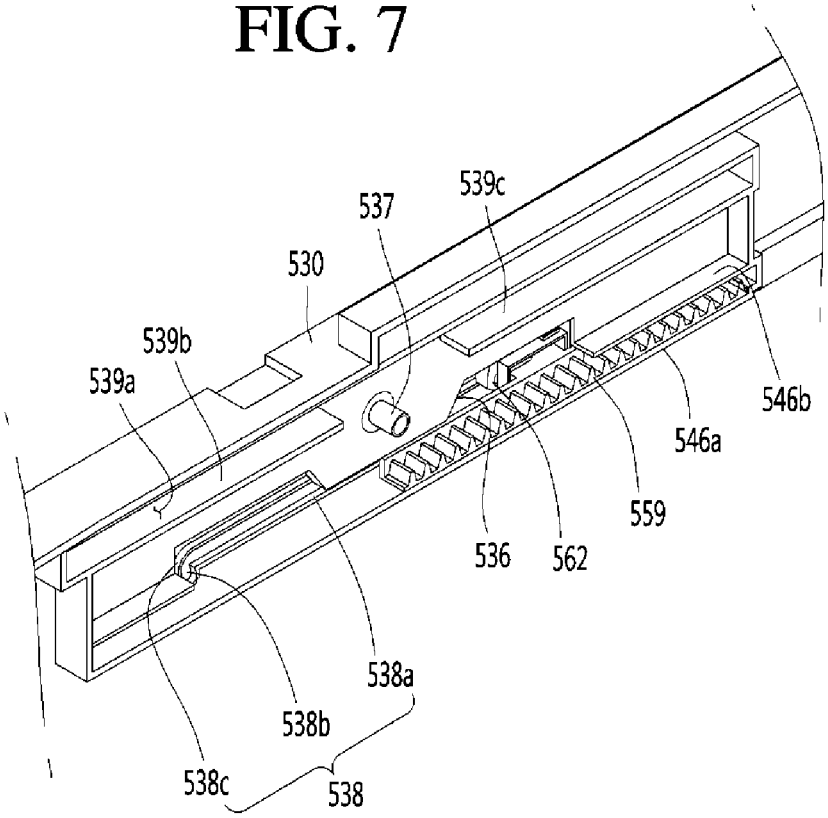
FIG. 7 illustrates a state where a first rack is seated on a supporter according to an embodiment.
Figure 8:
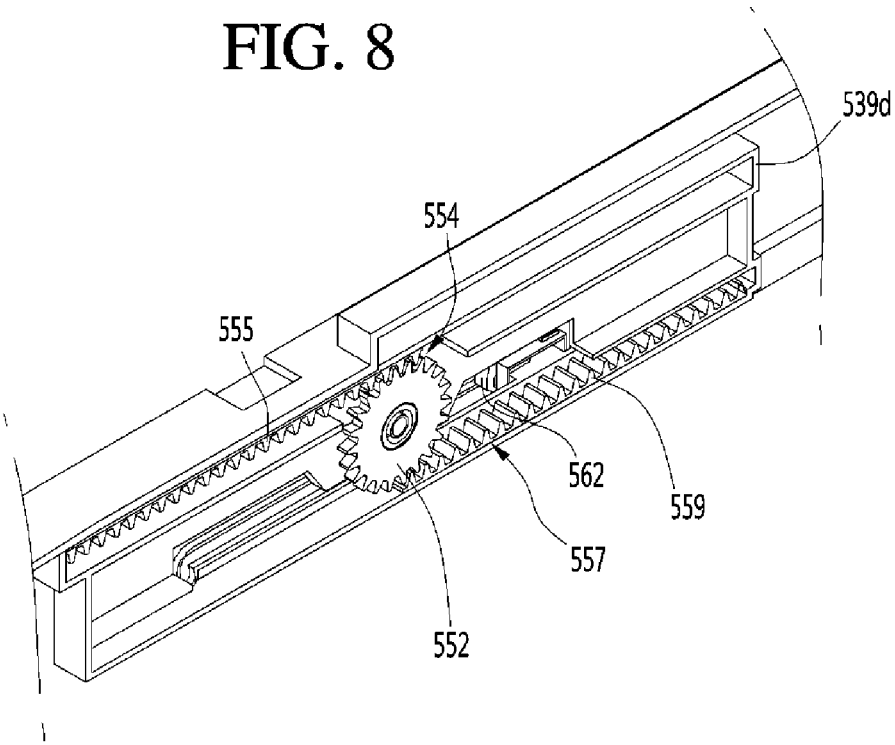
FIG. 8 illustrates a state where the transmission gear and the second rack are further coupled to the supporter in FIG. 7.
Figure 9:
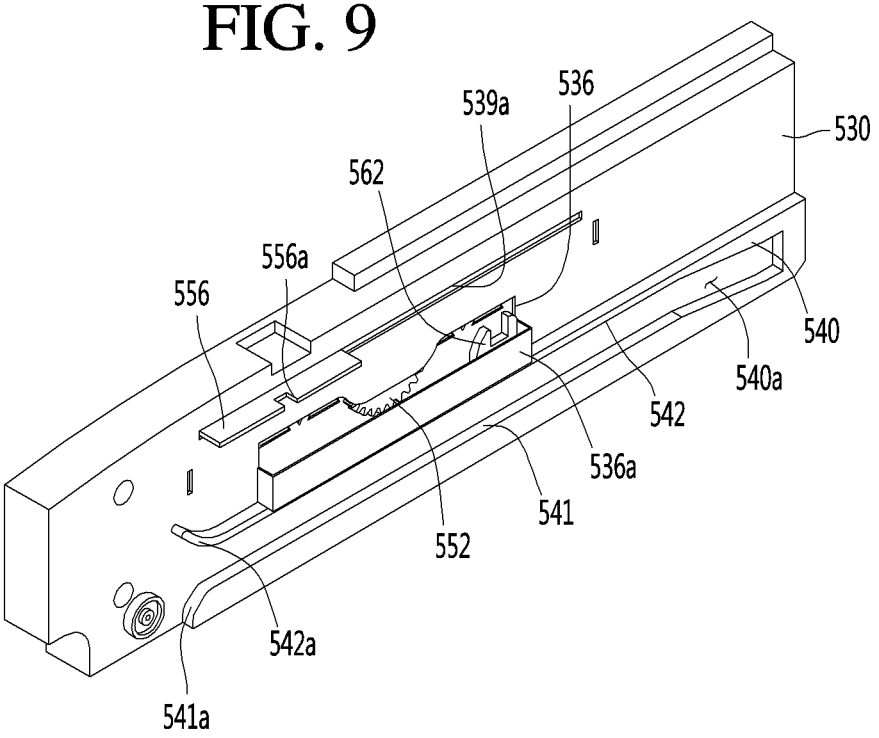
FIG. 9 is a perspective view illustrating a state where the transmission unit is coupled to the supporter.
Figure 10:
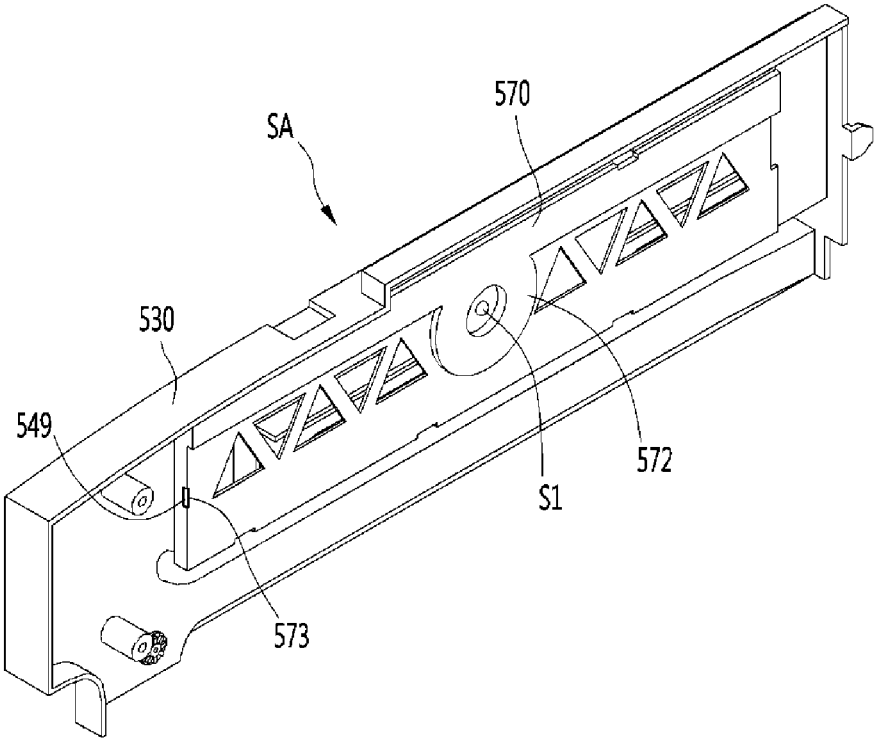
FIG. 10 is a perspective view illustrating a state where the unit cover is coupled to the supporter.

Referring to FIGS. 5 and 6, the connection member 562 may include a space portion (or notch) 563 formed by a portion of the upper surface thereof being recessed downward. The notch 563 may receive the transmission protrusion 519 of the basket 510.

The connection member 562 may include a front body 563*b* forming the notch 563, a rear body 563*c* spaced apart from the front body 563*b*, and a lower body 563*a* forming a bottom of the notch 563. Therefore, the transmission protrusion 519 may be received in the notch 563 between the front body 563*b* and the rear body 563*c*.

A first protrusion 564 and a second protrusion 565 which are spaced apart from each other in the horizontal direction may be provided on one surface of the lower body 563*a*. The first protrusion 564 and the second protrusion 565 may be arranged in a direction parallel to the linear movement direction of the connection member 562, for example.

The first protrusion 564 may overlap with the notch 563 in the vertical direction. The second protrusion 565 may be positioned in front of the first protrusion 564 and may overlap with the notch 563 in the vertical direction.

A rack coupling shaft 566 for coupling with the first rack 557 may be provided on the other surface of the lower body 563*a*. For example, the rack coupling shaft 566 may be rotatably coupled to the coupling body 558 of the first rack 557. To this end, the rack coupling shaft 566 may have a cylindrical shape so as to protrude from the other surface of the lower body 563*a* so that the connection member 562 may be rotated with respect to the first rack 557.

The rack coupling shaft 566 may be positioned on the opposite side of the first protrusion 564 with respect to the lower body 563*a*. In other words, the first protrusion 564 may horizontally overlap with the rack coupling shaft 566 in the lateral direction.

The lower body 563*a* may further include reinforcement grooves 569*a*, 569*b*, and 569*c* of a shape which is recessed so as to reduce the weight of the connection member 562 and to enhance the strength of the lower body 563*a*. One reinforcing groove 569*a* may be positioned around the rack coupling shaft 566, although not limited. In addition, another reinforcing groove 569*c* may be disposed around the first protrusion 564.

Referring to FIGS. 5 to 10, the supporter 530 may include a first rack guide 546*a* for guiding the movement of the first rack 557 while supporting the first rack 557, and a rack cover 546*b* covering the upper side of the first rack 557. The first rack 557 may be positioned between the first rack guide 546*a* and the rack cover 546*b*. The supporter 530 may further include a guide slot 538 for guiding the movement of the connection member 562. The guide slot 538 may be a groove shape which is formed by being recessed in the supporter 530.

The guide slot 538 may include a first slot 538*a* for guiding the linear movement of the connection member 562, and a second slot 538*b* which is bent at the front end of the first slot 538*a* and extends downward. The first slot 538*a* is formed in a linear shape. The second slot 538*b* may extend inclinedly at a front end of the first slot 538*a* and extend inclinedly rearward at the first slot 538*a*.

As will be described later, the connection member 562 may move along the first slot 538*a* and may be rotated in a process of moving from the front end portion of the first slot 538*a* toward the second slot 538*b*. The first protrusion 564 and the second protrusion 565 may be received in the guide slot 538. For example, the first protrusion 564 and the second protrusion 565 may be located in the first slot 538*a* at the fully inserted position of the basket 510.

The positional relationship between the first protrusion 564 and the second protrusion 565 in the guide slot 538 in a process of pulling-in of the receiving member 510 will be described later with reference to the drawings. The supporter 530 may further include a rack slot 539*a* through which the second rack 554 passes. The second rack 554 may further include a cover coupling rib 556 extending in the horizontal direction. The cover coupling rib 556 may pass through the rack slot 539*a*.

The rack slot 539*a* may be elongated in a direction (for example, a front and rear direction) parallel to the moving direction of the second rack 554 so that the cover coupling rib 556 of the second rack 554 which moves linearly does not interfere. The supporter 530 may further include a front guide 539*b*, and a rear guide 539*c*, which guide the movement of the second rack 554 in the front and rear direction.

The front guide 539*b* and the rear guide 539*c* may be spaced apart from each other in the front and rear direction and a portion of the transmission gear 552 may be positioned between the front guide 539*b* and the rear guide 539*c*. Therefore, the transmission gear 552 may be connected to the second rack 554 without interference with the front guide 539*b* and the rear guide 539*c*.

The supporter 530 may further include a stopper 539*d* for restricting the movement of the second rack 554 in a process of pulling-out the basket 510. The stopper 539*d* may be located behind the second rack 554 and when the cover 580 opens the receiving space 511 in a process of pulling-out the basket 510, the cover 580 may be stopped by restricting the movement of the second rack 554.

The position at which the cover 580 is stopped may be substantially the open completion position of the cover 580. The supporter 530 may further include a receiving portion 536*a* for receiving the connection member 562 passing through the opening 536. The receiving portion 536*a* may protrude from the supporter 530 toward the basket 510. The guide slot 538 may be formed in the receiving portion 536*a*.

The guide rail 540 of the supporter 530 may include a first guide portion (or first guide rail) 541, and a second guide portion (or second guide rail) 542 spaced from the first guide rail 541 above the first guide rail 541. A space 540*a* may be formed between the first guide rail 541 and the second guide rail 542, and the first roller 525 may rotate in the space 540*a*, and may move along the guide rails 540.

The vertical length between the first guide rail 541 and the second guide rail 542 may be equal to or larger than the diameter of the first roller 525. The first roller 525 may move along the upper surface of the first guide rail 541 while being rotated during the pulling-in and out of the basket 510 in a state of being seated on the upper surface of the first guide rail 541.

In an assembling process, each of the guide rails 541 and 542 may include inlet inclined portions 541*a* and 542*a* which may be inclined in a direction away from each other so that the first roller 525 of the basket 510 may be easily pulled or pushed in the space 540*a* of the guide rail 540. When the transmission unit 550 is installed on the supporter 530, the cover plate 570 may be coupled to the supporter 530 so that the cover plate 570 covers the transmission unit 550.

One or more cover coupling hooks 549 may be formed on the supporter 530 and one or more hook coupling holes 573 to which the cover coupling hooks 549 are fastened may be formed on the cover plate 570. The cover plate 570 may include a gear cover 572 that covers the transmission gear 552. The gear cover 572 may correspond to the transmission gear 552. A fastening member S1 may be fastened to the gear shaft 537 through the cover plate 570 when the cover plate 570 covers the transmission unit 550.

A configuration in which the transmission unit 550 is coupled to the supporter 530 and the cover plate 570 is coupled to the supporter 530 may be referred to as a supporter assembly SA. In other words, the supporter assembly SA may include a supporter 530, a transmission unit 550, and a cover plate 570.

Figure 11:
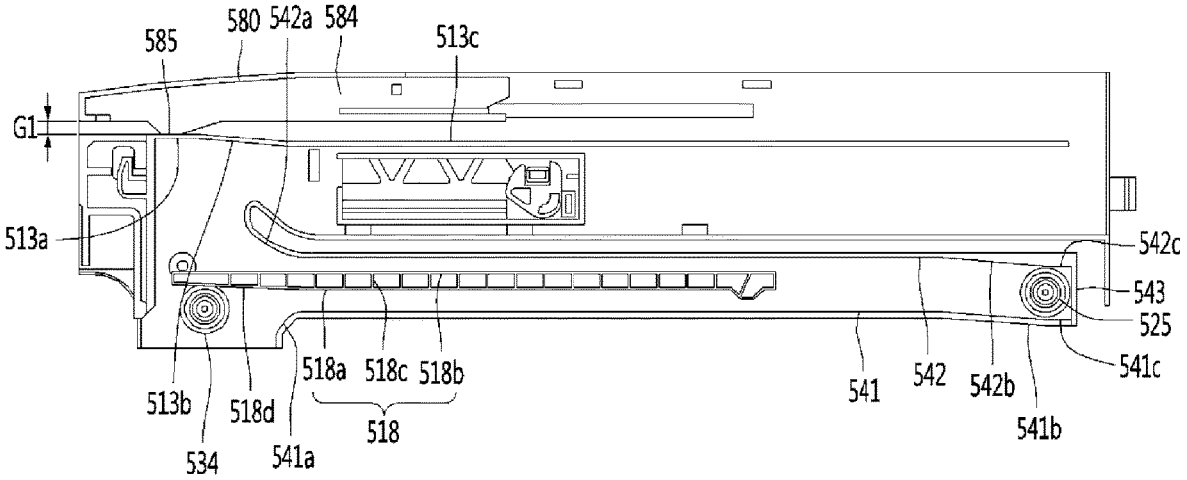
FIG. 11 is a sectional view taken along line A-A of FIG. 3.

Referring to FIG. 11, when the basket 510 is pulled in a state where the first roller 525 is received in the space 540*a* of the guide rail 540, each of the guide rails 541 and 542 of the guide rail 540 may include inclined surfaces 541*b* and 542*b* inclined downward toward the rear so that the basket 510 may be automatically moved to the fully inserted position.

The inclined surfaces 541*b* and 542*b* may include a first inclined surface 541*b* included in the first guide rail 541 and a second inclined surface 542*b* included in the second guide rail 542. "Automatic pulling-in" may mean that the basket 510 may be pulled or pushed in even if the user removes the force pushing the basket 510.

Although not limited, the inclination angle of the first and second inclined surfaces 541*b* and 542*b* with respect to the horizontal plane may be approximately 8 degrees so that the first roller 525 may be lowered along the first inclined surface 541*b* and the second inclined surface 542*b* by the load of the basket 510 and the cover 580 when no food is stored in the basket 510.

When the first roller 525 is positioned on each of the first and second inclined surfaces 541*b* and 542*b* in a case of moving along the upper surface of the first guide rail 541, the first roller 525 may be inclined downward and thus the basket 510 to which the first roller 525 is connected may be inclined downward and may be automatically moved to the fully inserted position.

The rear end portion of the first guide rail 541 and the rear end portion of the second guide rail 542 may be connected by a connection portion 543. The first roller 525 may remain in contact with the first and second inclined surfaces 541*b* and 542*b* when the basket 510 is moved to the fully inserted position. The first roller 525 may be in contact with the connection portion 543. Therefore, the connection portion 543 may serve as a stopper for stopping the basket 510 when the basket 510 is moved to the fully inserted position.

Alternatively, the guide rails 540 may further include horizontal portions 541*c* and 542*c* extending from the rear end portions of the first and second inclined surfaces 541*b* and 542*b* of the respective guide rails 541 and 542. The horizontal portions 541*c* and 542*c* may include a first horizontal portion 541*c* extending horizontally at the rear end portion of the first inclined surface 541*b* and a second horizontal portion 542*c* extending horizontally at the rear end portion of the second inclined surface 542*b*.

The first horizontal portion 541*c* of the first guide portion 541 and the second horizontal portion 542*c* of the second guide portion 542 may be connected by the connection portion 543. Also in this case, the first roller 525 may be in contact with the first and second inclined surfaces 541*b* and 542*b* and the connection portion 543 at the pulling-in completion position of the basket 510. For example, the length of the first and second horizontal portions 541*c* and 542*c* may be smaller than the radius of the first roller 525.

The first and second inclined surfaces 541*b* and 542*b* of the guide rail 540 may be inclined downward with respect to the insertion of the basket 510. Therefore, when the basket 510 is pulled out, the first roller 525 may be lifted along the first and second inclined surfaces 541*b* and 542*b*.

Since the first roller 525 may be positioned on the rear end portion of the side walls 513 and 514 of the basket 510, although the first roller 525 may be lifted along the first and second inclined surfaces 541*b* and 542*b*, the front portion of the basket 510 may not be lifted due to the load of the basket 510.

In this case, when the basket 510 linearly moves in an inclined state without being linearly moved in a horizontal direction, the load of the basket 510 may act as a moment of the first rack 557 and thus the basket 510 may not be smoothly pulled in and out. Therefore, the present embodiment may further include a horizontal keeping structure which may be lifted or lowered in a state the basket 510 forms a horizontal when the first roller 525 is lifted or lowered along the first and second inclined surfaces 541*b* and 542*b*.

Specifically, the supporter 530 may include a second roller 534 for supporting the guide protrusion 518 of the basket 510. A plurality of second rollers 534 may be installed on surfaces facing each other in a pair of supporters 530. The second roller 534 may be positioned in front of the guide rail 540 in the supporter 530.

The second roller 534 may be in contact with the lower surface of the guide protrusion 518 and may rotate by friction with the guide protrusion 518 in a process of pulling-in and out the basket 510, and thus facilitating the pulling-in and out of the basket 510.

The guide protrusion 518 may include a lower rib 518*a*, an upper rib 518*b* positioned above the lower rib 518*a*, and a plurality of connection ribs 518*c* which connect the lower rib 518*a* and the upper rib 518*b* to each other. The lower rib 518*a* may be in contact with the second roller 534 in a process of pulling-in and out the basket 510. The upper rib 518*b* may extend in a linear shape line in the horizontal direction.

A portion of the lower rib 518*a* may extend in a straight line in the horizontal direction and may be parallel to the upper rib 518*b*. The other portion of the lower rib 518*b* may be inclined upward toward the front. The lower rib 518*a* may include an inclined rib 518*d*. In other words, the horizontal keeping structure may include the inclined ribs 518*d*.

At this time, the inclination angle of the inclined ribs 518*d* may be the same as the inclination angle of the first and second inclined surfaces 541*b* and 542*b* of the guide rails 540. The front end portion of the inclined rib 518*d* may be connected to the upper rib 518*b*. The inclined ribs 518*d* and the upper ribs 518*b* may be connected by one or more connection ribs 518*c*.

Therefore, when the first roller 525 is lifted or lowered along the first and second inclined surfaces 541*b* and 542*b*, the front side of the basket 510 may be lifted or lowered together by the inclined ribs 518*d*. Meanwhile, the cover 580 or the connection frame 584 may include a spacer rib 585 protruding downward. For example, the spacer ribs 585 may protrude downward from the connection frame 584.

The spacer ribs 585 may be in contact with the upper surfaces of the side walls 513 and 514 of the basket 510 at the fully inserted position of the basket 510. For example, the spacer ribs 585 may be in contact with a side of the front end portion of the upper surface of the side walls 513 and 514.

The cover 580 and the upper surface of the basket 510 may be spaced apart from each other by the spacer ribs 585 at the fully inserted position of the basket 510. In other words, a gap G1 may exist between the cover 580 and the basket 510. The gap G1 may allow the refrigerating chamber 11 and the receiving space 511 of the basket 510 to communicate with each other at the fully inserted position of the basket 510. Therefore, cold air may circulate through the receiving space 511 and the refrigerating chamber 11.

The refrigerator 1 may further include a temperature sensor for sensing the temperature of the receiving space 511. The amount of cool air supplied to the receiving space 511 may be determined based on the temperature sensed by the temperature sensor.

When there is no gap between the cover 580 and the basket 510, since the cool air may stagnate in the receiving space 511 and the temperature sensed by the temperature sensor may be lowered, the cold air may not flow into the receiving member 511. When the temperature of the receiving space 511 sensed by the temperature sensor increases, cool air may again be supplied to the receiving space 511. As described above, when the cold air supply and supply interruption are repeated, the temperature change width of the food stored in the receiving space 511 may become large, and the freshness of the food may become low.

On the other hand, since the receiving space 511 and the refrigerating chamber 11 may communicate with each other by the gap G1 existing between the cover 580 and the basket 510 and thus the cool air may be circulated, the temperature change width of the food stored in the receiving space 511 may be minimized and freshness may be kept. The basket 510 may be lifted by the first and second inclined surfaces 541*b* and 542*b* and the inclined ribs 518*d* in a process of pulling-out of the basket 510.

When the sidewalls 513 and 514 of the basket 510 have the same height, the sidewalls 513 and 514 may interfere with the spacer ribs 585 in the process of pulling-out of the basket 510. Therefore, in order to prevent the side walls 513 and 514 of the basket 510 from interfering with the spacer ribs 585 in the process of pulling-out the basket 510, each of the side walls 513 and 514 of the basket 510 may include a first wall 513*a* having a horizontal upper surface, an inclined wall 513*b* having an upper surface inclined downward as it goes backward from the first wall 513*a*, and a second wall 513*c* which extends rearward from the inclined wall 513*b* and has a horizontal upper surface.

At this time, the inclination angle of the upper surface of the inclined wall 513*b* may be the same as the inclination angle of the first and second inclined surfaces 541*b* and 542*b* of the guide rail 540. Thus, in a process of pulling-in the basket 510, the basket 510 may be stably moved to the fully inserted position by the first and second inclined surfaces 541*b* and 542*b* of the guide rail 540.

In addition, in a process of pulling-out the basket 510, the basket 510 may be moved in a state of being kept horizontal without being inclined forward and backward by the inclining rib 518*d* and the inclined wall 513*b* and thus stable pulling-out may be possible.

In addition, when the cover 580 covers the receiving space 511 at the fully inserted position of the basket 510, since the spacer ribs 585 may be seated on the first wall 513*a*, the phenomenon that the cover 580 is inclined toward the front side may be prevented.

Figure 12:
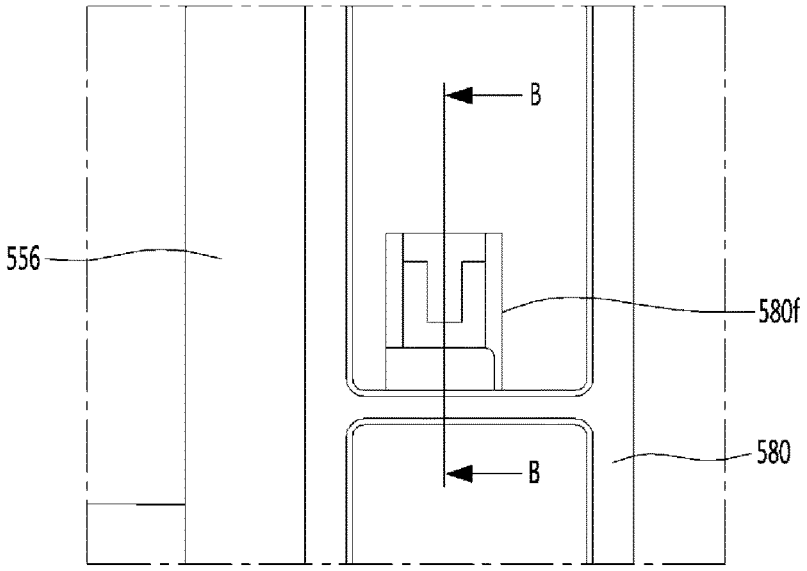
FIG. 12 is an enlarged view illustrating portion C in FIG. 3.
Figure 13:
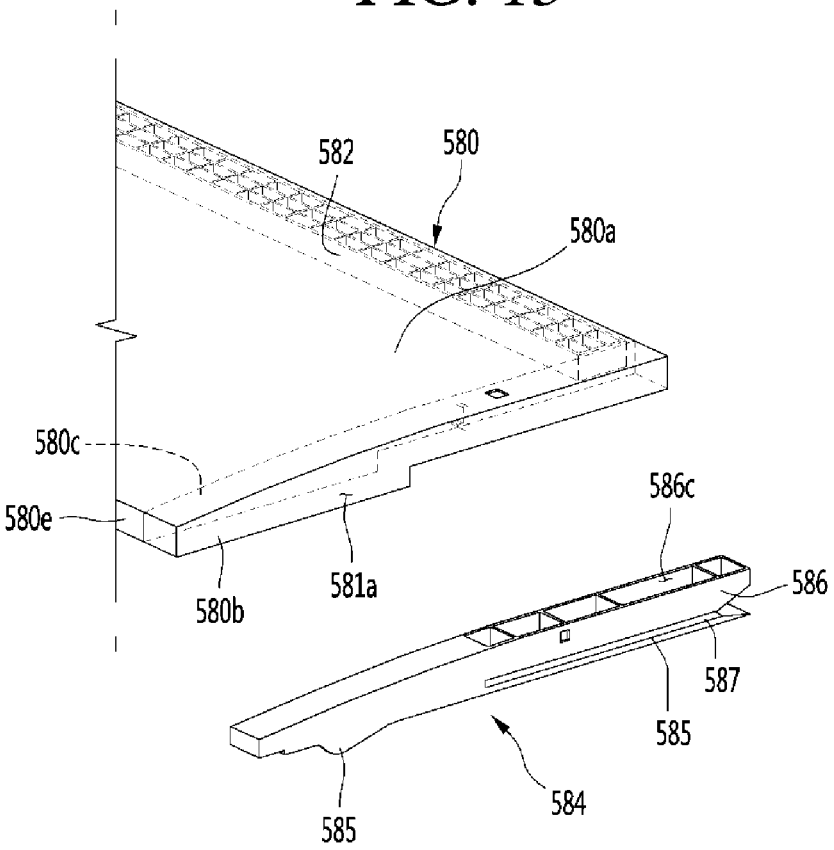
FIG. 13 illustrates a state where a connection frame is separated from a cover member according to an embodiment.
Figure 14:
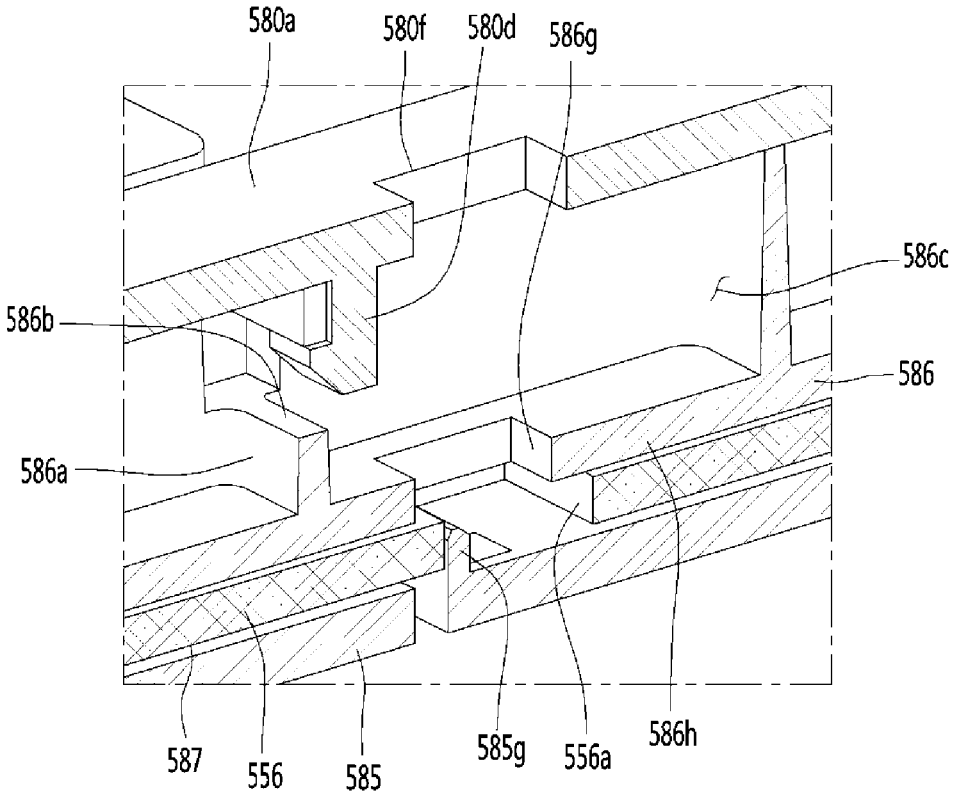
FIG. 14 is a sectional view taken along line B-B in FIG. 12.

Referring to FIGS. 12 to 14, the connection frame 584 may be coupled to the cover 580. The connection frame 584 may be detachably coupled to the second rack 554 when the connection frame 584 is coupled to the cover 580. Therefore, the cover 580 may be separated from the pantry assembly 50 when the pantry assembly 50 is installed in the inner case 101.

The cover 580 may include an upper wall 580*a*, a pair of outer walls 580*b* extending downward from both ends of the upper wall 580*a*, and a front wall 580*e* extending downward from the front end of the upper wall 580*a*. The front wall 580*e* may connect the pair of outer walls 580*b*. The cover 580 may further include a pair of inner walls 580*c* spaced apart from the pair of outer walls 580*b* between the pair of outer walls 580*b*.

Each of the inner walls 580*c* may extend downward from the lower surface of the cover 580. Therefore, a space 581*a* may be formed between the inner wall 580*c* and the outer wall 580*b*, and the connection frame 584 may be received in the space 581*a*.

The connection frame 584 may include a rib receiving slot 587 for receiving the cover coupling rib 556 of the second rack 554. In other words, the cover coupling rib 556 of the second rack 554 may be received in the rib receiving slot 587 through the rack slot 539*a*.

The rib receiving slot 587 may have a predetermined length from the rear end portion toward the front end of the connection frame 584. The connection frame 584 may be divided into an upper frame 586 and a lower frame 585 with reference to the rib receiving slot 587.

The upper frame 586 may include a recessed portion 586*c* formed by a portion of the upper surface thereof being recessed downward. The weight of the upper frame 586 may be reduced by the recessed portion 586*c* and the strength thereof may be improved.

The recessed portion 586*c* may include a coupling wall 586*a* for coupling with the cover 580. A coupling hole 586*b* may be formed in the coupling wall 586*a*. The upper surface 580*a* of the cover 580 may include a coupling hook 580*d* to be coupled to the coupling wall 586*a*.

The coupling hook 580*d* may be received in the recessed portion 586*c* in a process in which the connection frame 584 is received in the space 581*a* between the inner wall 580*c* and the outer wall 580*b*, and is hooked to the coupling hole 580*b* of the coupling wall 586*a*. A hook hole 556*a* may be formed in the cover coupling rib 556 of the second rack 554. The hook hole 556*a* may be located at approximately the central portion of the cover coupling rib 556.

The lower frame 585 may include a frame hook 585*g* for hooking the hook hole 556*a*. When the frame hook 585*g* is hooked to the hook hole 556*a* in a process in which the cover coupling rib 556 is received in the rib receiving slot 587, the coupling of the connection frame 584 and the second rack 554 may be completed.

The connection frame 584 and the cover 580 may be referred to as a cover unit. The hooking of the frame hook 585*g* and the hook hole 556*a* may be released by a tool operated by a user. In order to move the tool, a first opening 580*f* may be formed on the upper wall 580*a* and a second opening 586*g* may be formed on the bottom surface 586*h* of the recessed portion 586*c*.

The first opening 580*f* and the second opening 586*g* may overlap with the hook hole 556 and the frame hook 585*g* in the vertical direction. Accordingly, the frame hooks 585*g* may be pressed so that the frame hook 585*g* is separated from the hook hole 556*a* when the tool is sequentially passed through the first opening 580*f* and the second opening 586*g* from the upper side of the cover 580.

A rib 582 extending downward may be provided on a side of the rear end portion of the upper wall 580*a* so that the center of gravity of the cover 580 is positioned on the rear side of the cover 580. The ribs 582 may be formed in a lattice shape, for example, and may be positioned between the pair of inner walls 580*c* at the upper wall 580*a*.

Figure 15:
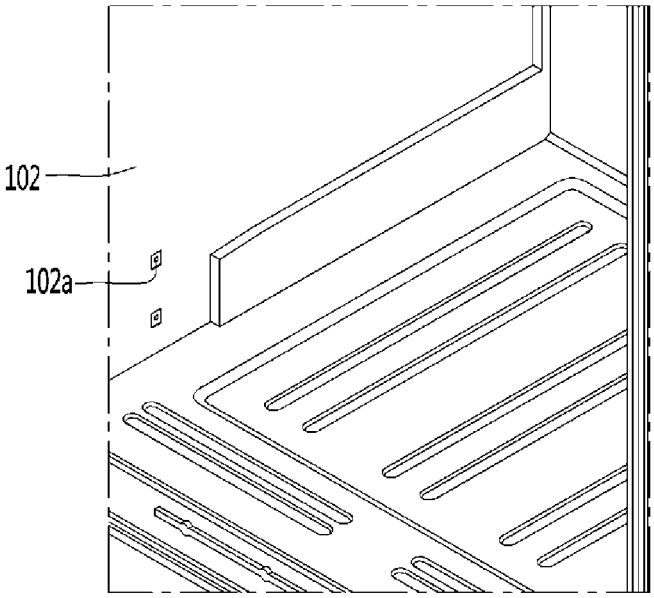
FIGS. 15 and 16 are views illustrating a process in which the pantry assembly is assembled to the inner case.
Figure 15:
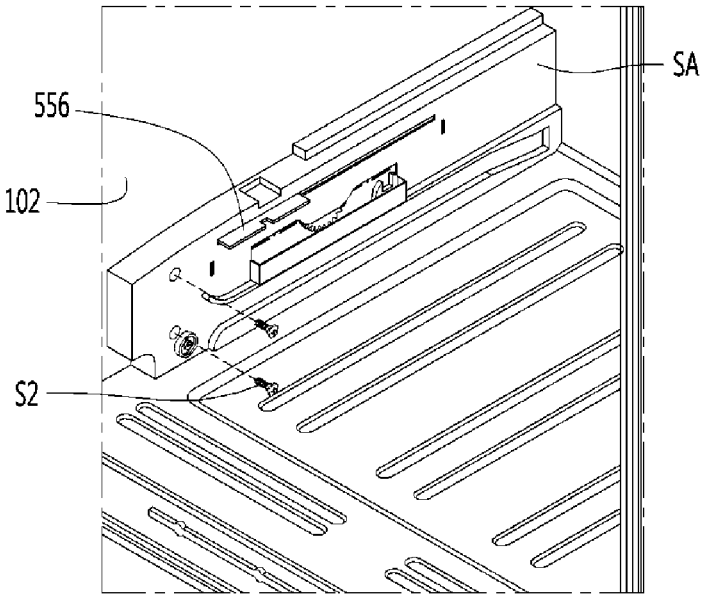
Figure 16:
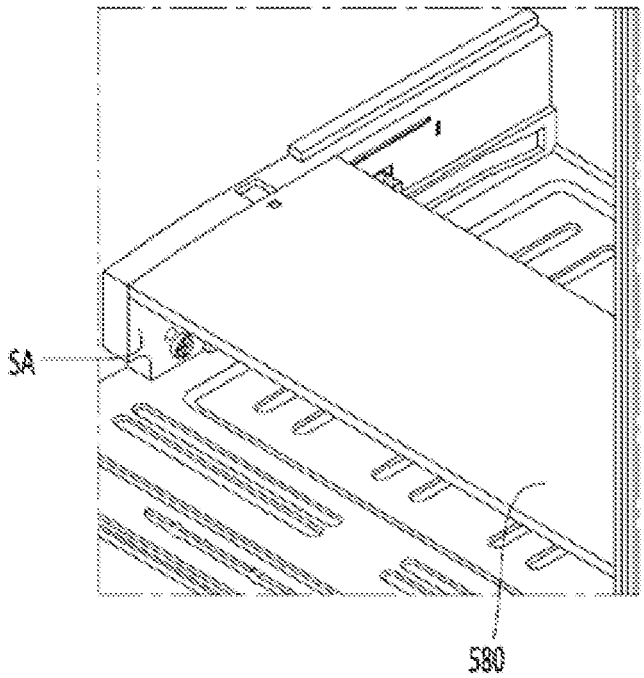
Figure 16:
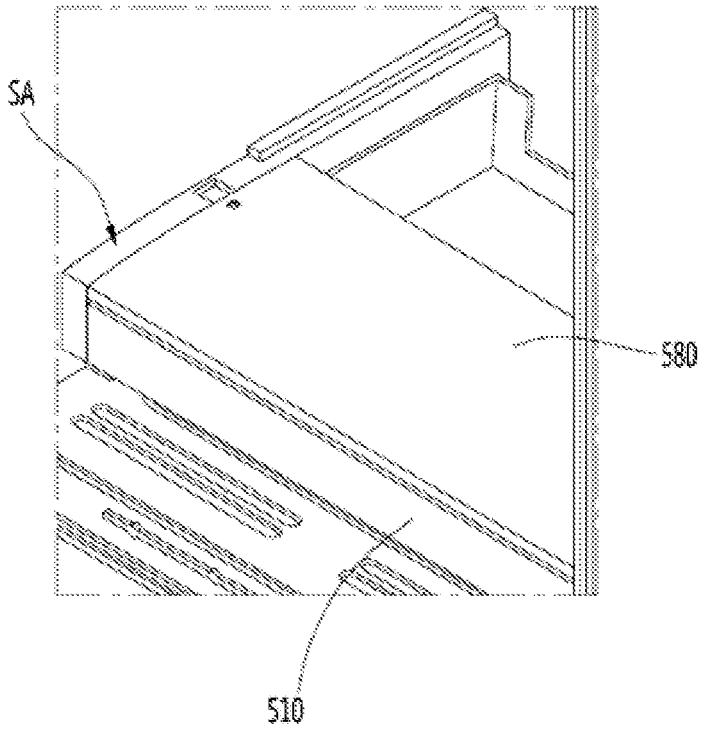

FIG. 15 (*a*) illustrates the side wall of the inner case, and FIG. 15 (*b*) illustrates a state where the supporter assembly is assembled on the side wall of the inner case. FIG. 16 (*a*) illustrates a state where the cover member is coupled to the supporter assembly, and FIG. 16 (*b*) illustrates a state where the receiving member is coupled to the supporter assembly.

Referring to FIG. 15, a fastening hole 102*a* for fastening the fastening member S2 may be formed on each side wall 102 of the inner case. After the supporter assembly SA is assembled, the fastening bosses 531 of the supporters 530 may be aligned with the fastening holes 102*a*, and the fastening members S2 may be fastened to the fastening bosses 531 and the fastening hole 102*a*.

Next, as illustrated in FIG. 16 (*a*), a connection frame 584 connected to the cover 580 may be coupled to a cover coupling rib 556 of a second rack 554 protruding outside the supporter 530. When the cover 580 is connected to the supporter assembly SA, when the basket 510 is pushed after the first roller 525 and the guide protrusion 518 of the basket 510 are received into a space 540*a* of the guide rail 540 of the supporter 530, the assembling of the pantry assembly 50 may be completed.

Figure 17:
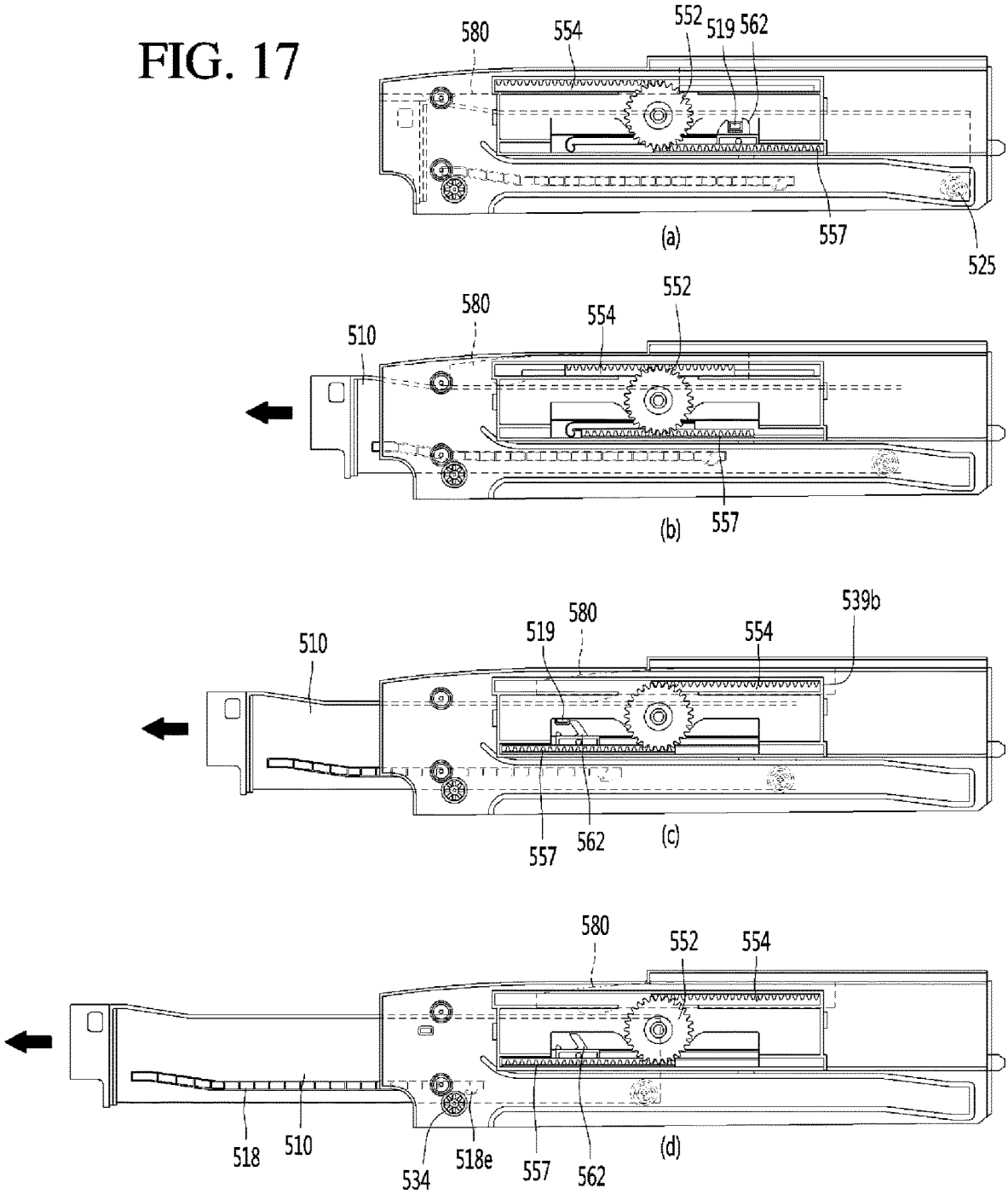
FIG. 17 illustrates a process of pulling-out of a receiving member according to an embodiment in stages.
Figure 18:
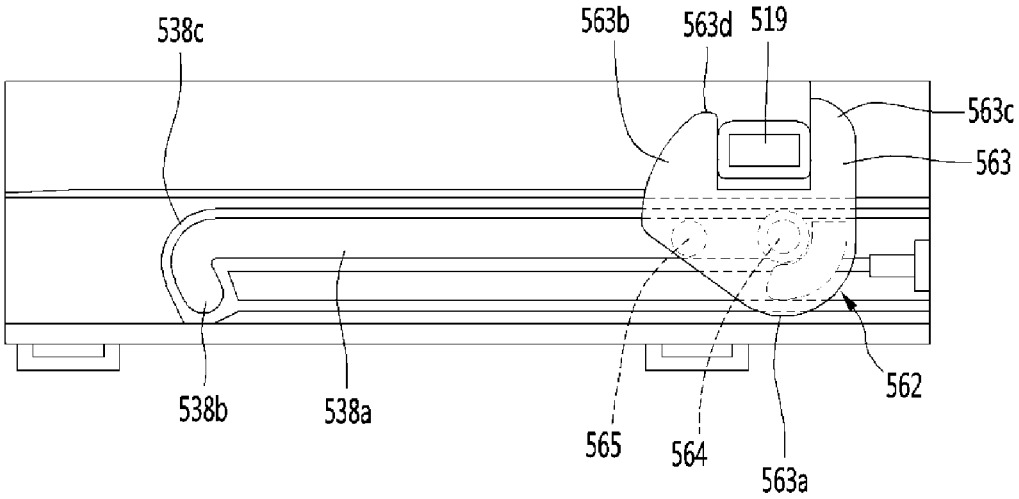
FIG. 18 illustrates the state of the connection member at a pulling-in completion position of the receiving member.
Figure 19:
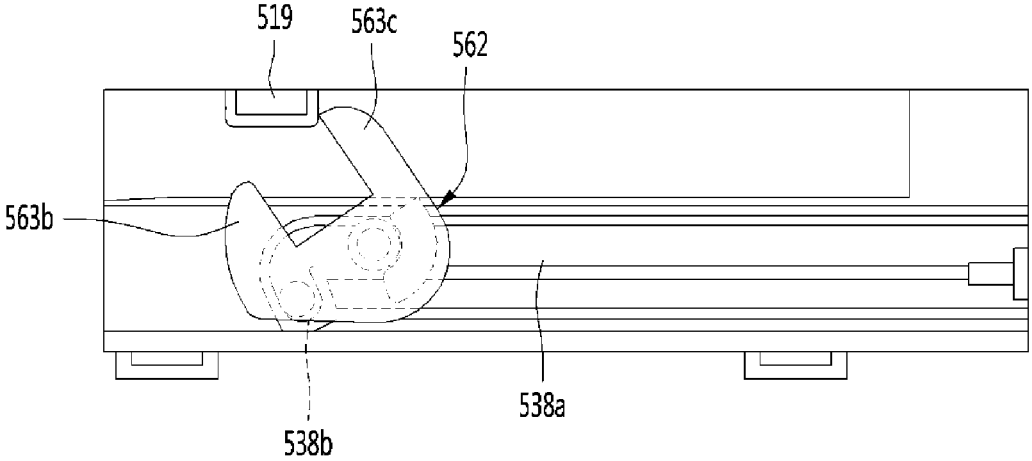
FIG. 19 illustrates a state where a connection member is rotated according to an embodiment.

FIG. 17 (*a*) illustrates a state where the receiving member is located at the pulling-in completion position, and FIG. 17 (*b*) illustrates a state where the receiving member is pulled out by the first distance at the pulling-in completion position. FIG. 17 (*c*) illustrates a state where the receiving member is pulled out by a second distance and the cover member has moved to the opening completion position, and FIG. 17 (*d*) illustrates a state where the receiving member has moved to the pulling-out completion position.

Referring to FIGS. 4 to 19, the transmission protrusion 519 of the basket 510 may be positioned at the notch 563 of the connection member 562 at the fully inserted position of the basket 510. The connection member 562 may be positioned behind the transmission gear 552. The transmission gear 552 may mesh with the front end of the first rack gear 559 and may mesh with the rear end of the second rack gear 555.

At this time, at least one gear or tooth of the first rack gear 559 and at least one gear or tooth of the second rack gear 555 may be overlapped in the vertical direction. The gear ratio of the transmission gear 552 to the first rack gear portion 559 may be set to 1:1, although not limited thereto. In addition, the gear ratio between the transmission gear 552 to the second rack gear portion 554 may be set to 1:1. In addition, the first protrusion 564 and the second protrusion 565 of the connection member 562 may be located in the first slot 538*a*.

In this state, when the basket 510 is pulled toward the user to pull out the basket 510, the basket 510 may be moved linearly in the horizontal direction after being lifted to a predetermined height by the inclined surface 541*b* and 542*b* of the guide rail 540.

At this time, in a case where the first protrusion 564 and the second protrusion 565 of the connection member 562 are positioned in the first slot 538*a*, in the process of pulling-out of the basket 510, the rotation of the connection member 562 may be restricted and the connection member 562 may be linearly and moved stably. In a case where the connection member 562 linearly moves, the first rack 557 connected to the connection member 562 may linearly move in the first direction (arrow direction in FIG. 17).

When the first rack 557 moves in the first direction, the transmission gear 552 may be rotated in the clockwise direction in the drawing, and the rotation of the transmission gear 552 may cause the second rack 554 to be linearly moved in a second direction opposite to the first direction. Then, the cover 580 may move in the second direction together with the second rack 554, so that the basket 511 of the receiving member 510 is opened.

In the present embodiment, the upper surface of the transmission protrusion 519 may be positioned lower than the upper ends of the front body 563*b* and the rear body 563*c* forming the notch 563. The height of the front body 563*b* may be lower than the height of the rear body 563*c*. Therefore, the upper surface of the transmission protrusion 519 may be positioned lower than the upper end 563*d* of the front body 563*b*.

This is because the basket 510 may be lifted by the inclined surfaces 541*b* and 542*b* of the guide rail 540 at the initial pulling-out of the basket 510, so that the transmission protrusion 519 may be prevented from being separated from the notch 563. In addition, in order to prevent the transmission protrusion 519 from being separated, the upper surface of the transmission protrusion 519 may be positioned at a position lower than the upper end 563*d* of the front body 563*b* at a position in which the transmission protrusion 519 is lifted.

Therefore, even if the transmission protrusion 519 is lifted due to the lifting of the basket 510, the transmission protrusion 519 may be kept in a state where the transmission protrusion 519 is positioned at the notch 563, and thus the connection member 562 may be moved together when the transmission protrusion 519 is moved as illustrated in FIG. 17 (*b*).

In other words, when the basket 510 is pulled out, the transmission protrusion 519 may be in contact with the front body 563*b* of the connection member 562 to push the front body 563*b* forward.

Referring to FIGS. 17 (*c*) and 19, when the second rack 554 is in contact with the stopper 539*b* in a process of pulling-out of the basket 510, the moving of the second rack 554 may be restricted, and the cover 580 may be stopped. In the present embodiment, the position of the cover 510 when the second rack 554 contacts the stopper 539*b* may be referred to as an opening completion position.

If the movement force of the basket 510 is continuously transmitted to the cover 580 in a state where the cover 580 is stopped, the transmission unit and/or the cover 580 may be broken. Therefore, the second protrusion 565 of the connection member 562 may be aligned with the second slot 538*b* just before the cover 580 is moved to the opening completion position and stopped. In this state, when the basket 510 is further pulled forward, the second protrusion 565 may be moved to the second slot 538*b*, and the connection member 562 may be rotated in this process.

The connection member 562 may be rotated around the rack coupling shaft 566. The guide slot may include a curved guide surface 538*c* which connects the first slot 538*a* and the second slot 538*b* to each other so that the second protrusion 565 may smoothly move into the second slot 538*b* in the first slot 538*a*.

When the connection member 562 is rotated, the height of the front body 563*b* of the connection member 562 may be lowered so that the front body 563*b* may be deviated from the moving path of the transmission protrusion 519. Therefore, the transmission protrusion 519 may continuously move in the first direction without interfering with the front body 563*b*. On the other hand, the moving force of the transmission protrusion 519 may no longer be transmitted to the connection member 562. Therefore, in a state where the cover 580 is stopped, the basket 510 may move in the first direction.

In a case of the present embodiment, since the second slot 538*b* may be inclined downwardly from the front end portion of the first slot 538*a* toward the rear, unless the rotational force is applied to the connection member 562, the connection member 562 may be prevented from rotating clockwise with reference to FIG. 17.

Referring to FIG. 17 (*d*), when the cover 580 is stopped, the basket 510 may be continuously pulled out in the first direction. The pulling-out of the basket 510 may be restricted by a pulling-out restricting portion 518*e* provided in the basket 510 in a process of pulling out the basket 510.

The position at which the pulling-out of the basket 510 is restricted and thus the basket 510 is stopped is the pulling-out completion position. For example, the pulling-out restricting portion 518*e* may be provided on the guide protrusion 518. The pulling-out restricting portion 518*e* may protrude downward from the rear end portion of the lower rib 518*a*.

The pull-out restricting portion 518*e* may be in contact with the second roller 534 of the supporter 530 at the pull-out completion position. The pulling-out restricting portion 518*e* may have a curved surface for surface contact with the second roller 534 so that the basket 510 may be kept a state of being stopped at the pull-out completion position.

Referring to FIGS. 17 to 20, the basket 510 may be pushed to be moved in the second direction so that the basket 510 which is moved to the pulling-out completion position is pulled or pushed in. Since the transmission protrusion 519 of the basket 510 is deviated or disengaged from the space portion 563 of the connection member 562 at the beginning of the pulling-in of the basket 510, the connection member 562 may keep a state of being stopped at the time of moving of the basket 510. In other words, the cover 580 may remain stopped at the opening completion position.

Figure 20:
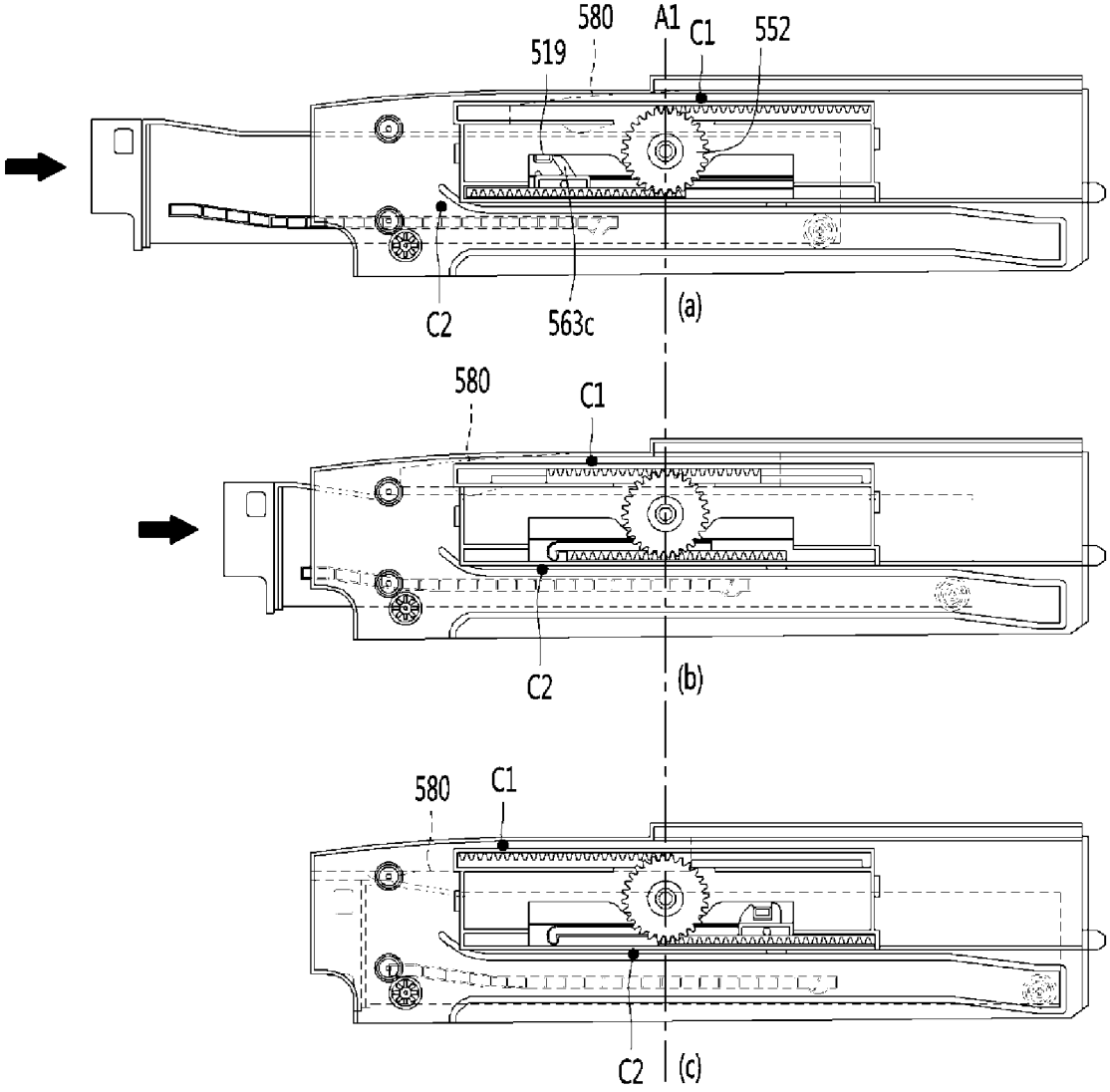
FIG. 20 illustrates a relative position between the center of gravity of the receiving member and the center of gravity of the cover member.

Next, as illustrated in FIG. 20 (*a*), the transmission protrusion 519 may be in contact with the rear body 563*c* of the connection member 562 in a process in which the basket 510 is pulled or pushed in. As illustrated above, since the height of the rear body 563*c* may be higher than the height of the front body 563*b*, even if the connection member 562 is rotated in the process of pulling-out of the basket 510, the rear body 563*c* may be located on the path of the transmission protrusion 519.

Accordingly, when the transmission protrusion 519 pushes the rear body 563*c* backward (second direction), the connection member 562 may be rotated in the clockwise direction in the drawing, and the transmission protrusion 519 may be positioned in the notch 563 of the connection member 562. In this state, when the basket 510 is continuously pushed in, the transmission protrusion 519 may push the rear body 563*c*, so that the connection member 562 is moved in the second direction together with the basket 510.

Then, the first rack 557 may move together with the connection member 562 in the second direction, and the transmission gear 552 may be rotated counterclockwise in the drawing. As the transmission gear 552 rotates, the second rack 554 may linearly move in the first direction. Then, the cover 580 may move in the first direction together with the second rack 554 to close the receiving space 511 of the basket 510.

When the first roller 525 encounters the first and second inclined surfaces 541*b* and 542*b* of the guide rail 540 while the basket 510 is moving toward the fully inserted position, the basket 510 may be automatically moved to the fully inserted position while being lowered by the first and second inclined surfaces 541*b* and 542*b*. At this time, the first and second inclined surfaces 541*b* and 542*b* may automatically move the basket 510 to the fully inserted position even if there is no force to push the basket 510.

Referring to FIG. 20 (*c*), an imaginary line A1 passing vertically through the rotation shaft of the transmission gear 552 at the fully inserted position of the basket 510 may be closer to the front end than rear end of the pantry assembly 50. In addition, in a fully inserted position of the basket 510, the center of gravity C2 of the basket 510 and the center of gravity C1 of the cover 580 may be located forward of the imaginary line A1 passing through the rotation shaft vertically.

In the present specification, the "front" of the imaginary line A1 may be a direction toward the front surface of the basket 510 from the imaginary line A1 and the "rear" may be a direction toward the rear side wall of the basket 510 from the imaginary line A1. The center of gravity C2 of the basket 510 may be positioned closer to the imaginary line A1 than the center of gravity C1 of the cover 580.

The transmission protrusion 519 and the connection member 562 may be located behind the imaginary line A1. In addition, the rear end portion of the cover 580 may be positioned behind the imaginary line A1. At this time, at least a portion of the ribs 282 of the cover 580 may be positioned behind the imaginary line A1.

Referring to FIG. 20 (*b*), when the first roller 525 of the basket 510 enters the first and second inclined surfaces 541*b* and 542*b* of the guide rail 540, the center of gravity C2 of the basket 510 and the center of gravity C1 of the cover 580 may be positioned forward of the imaginary line A1. The center of gravity C2 of the basket 510 may be positioned forward of the center of gravity C1 of the cover 580.

Referring to FIG. 20 (*a*), when the cover 580 is moved to the opening completion position, the center of gravity C2 of the basket 510 may be positioned forward of the imaginary line A1. On the other hand, the center of gravity C1 of the cover 580 may be located behind the imaginary line A1.

According to the present embodiment, there is an advantage that, when the receiving member is moved from the pulling-out completion position to the pulling-in completion position, the receiving member may be automatically returned to the pulling-in completion position by the inclined surface of the guide rail without the elastic force of the elastic member. In addition, according to the present embodiment, since the guide protrusion provided on the side wall of the receiving member includes the inclined rib, when the height is changed by the inclined surface in a process in which the receiving member is pulled in and out, there is an advantage that the entire receiving member may be kept horizontal without being inclined.

In addition, in the present embodiment, since the connection frame is connected to the cover member and the connection frame is connected to the second rack of the transmission unit 550, in a process in which the cover member is operated to open and close the receiving space of the receiving member, the cover member may be prevented from being damaged.

In addition, according to the present embodiment, the gap between the cover member and the receiving member may be formed by the cover member or the spacer rib formed on the connection frame, so that the cool air flow may be smooth, and in a state where the cover member covers the receiving space, a phenomenon in which the cover member tilts forward may be prevented.

The present embodiment provides a refrigerator in which a receiving member may automatically return to a pulling-in or pushed in completion position in a process in which the receiving member is pulled or pushed in without an elastic force of an elastic member. The present embodiment provides a refrigerator in which the entire receiving member may be kept horizontal without being inclined when the receiving member is changed in height in a process in which the receiving member is pulled in and out. The present embodiment provides a refrigerator in which the cover member may be prevented from being broken in a process of pulling-in and out of the receiving member.

A refrigerator may include: a cabinet having an inner case forming a storage chamber; and a pantry assembly installed on both side walls of the inner case. The pantry assembly may include a receiving member forming a receiving space and capable of being pulled in and out from the storage chamber; a supporter assembly connected to the receiving member and guiding the pulling-in and out of the receiving member; and a cover member which is connected to the supporter assembly, covers the receiving space, and can move in a direction opposite to the receiving member when the receiving member is pulled in and out.

The receiving member may include a first roller installed close to the rear end portion of both side walls, and the supporter assembly may include a supporter having a guide rail forming a space for receiving the first roller. The guide rail may include a first guide portion, and a second guide portion located above the first guide portion and forming the space together with the first guide portion, and the first roller may be supported by the first guide portion in a state where the first roller is received in a space of the guide rail.

The first guide portion may include a first inclined surface which is inclined so that the receiving member is lowered in a process of pulling-in of the receiving member. The second guide portion may include a second inclined surface inclined at the same angle as the first inclined surface of the first guide portion.

In this embodiment, the guide rail may further include a connection portion connecting the first inclined surface of the first guide portion and the second inclined surface of the second guide portion with each other. Alternatively, the guide rails may further include first and second horizontal portions extending from the inclined surfaces of the guide portions, respectively, and the first and second horizontal portions of the guide portions may be connected by a connection portion, respectively.

The length of the first and second horizontal portions may be smaller than the radius of the first roller. In the present embodiment, the receiving member may move between a fully inserted position and a fully withdrawn position.

The first roller may be in contact with the first inclined surface of the first guide portion before the receiving member is moved to the fully inserted position. In the present embodiment, the receiving member may further include a guide protrusion protruding from both side walls and extending in the front and rear direction of the receiving member.

The supporter may further include a second roller for supporting the guide protrusion, and the guide protrusion may include an inclined rib with which the second roller is in contact when the first roller is in contact with the first inclined surface of the first guide portion. The first and second inclined surfaces and the inclined ribs may allow the receiving member to move while keeping horizontal without being inclined in the front and rear direction in a process of pulling-in and out of the receiving member.

The inclined angle of the inclined rib may be the same as the inclined angle of the first guide portion. In the present embodiment, the guide protrusion may include a lower rib, an upper rib spaced apart from the lower rib, and a plurality of connecting ribs connecting the lower rib and the upper rib with each other. The lower rib may include the inclined rib, and the inclined rib may be connected to the front end portion of the upper rib. The inclined rib and the upper rib may be connected by one or more connecting ribs.

The refrigerator of the present embodiment may further include a connection frame connected to both sides of the cover member, in which the supporter assembly may further include a transmission unit 550 which is connected to the connection frame and transmits the movement force of the receiving member to the cover member. At least one of the cover member and the connection frame may include a spacer rib so that a gap exists between the cover member and the receiving member.

The spacer rib may extend downward from at least one of the cover member and the connection frame and may be seated on the upper surfaces of the side walls on both sides of the receiving member. Each of the side walls of the receiving member may include a first wall having a horizontal upper surface, an inclined wall having an upper surface inclined downwardly from the first wall toward the rear side, and a second wall extending rearward from the inclined wall and having a horizontal upper surface.

When the first roller is in contact with the first inclined surface of the first guide portion, the spacer rib may be in contact with the inclined wall. The inclined angle of the upper surface of the inclined wall may be the same as the first inclined surface of the first guide portion. The receiving member may include a transmission protrusion to be connected to the transmission unit 550.

The transmission unit 550 may include a connection member connected to the transmission protrusion of the receiving member, a first rack connected to the connection member, a transmission gear engaged with the first rack, and a second rack engaged with the transmission gear connected to the cover member. An imaginary line A1 passing through the rotation shaft of the transmission gear vertically may be positioned closer to the front end than the rear end of the pantry assembly at the fully inserted position of the receiving member.

At the fully inserted position of the receiving member, the center of gravity C2 of the receiving member and the center of gravity C1 of the cover member may be located forward of the imaginary line A1 and the transmission protrusion and the connection member may be located behind the imaginary line A1. At the fully inserted position of the receiving member, the rear end portion of the cover member may be located behind the imaginary line A1.

The cover member may further include a rib extending downward from a rear end portion of the cover member, wherein at least a portion of the rib is located behind the imaginary line A1, at the fully inserted position of the receiving member. The ribs may be formed in a lattice shape as an example.

The cover member may be moved to the opening completion position before the receiving member is moved from the inserted position to the withdrawn position. At the opening completion position of the cover member, the center of gravity C1 of the cover member may be located behind the imaginary line A1.

The second rack may include a cover coupling rib which is connected to the connecting frame and includes a hook hole. The connecting frame may include a slot for receiving the cover coupling rib and a frame hook for hooking the hook hole of the cover coupling rib received in the slot. The cover member may include a first opening, and the connection frame may include a second opening aligned with the first opening and the hook hole.

Embodiments disclosed herein may be implemented as a refrigerator comprising a cabinet including an inner case, and a drawer assembly provided in the inner case. The drawer assembly may include a basket which forms a receiving space and may be configured to be inserted into or withdrawn from the inner case to be movable between a first position and a second position, the first position being a position where the basket may be inserted into the inner case by a maximum insertion amount, and the second position being a position where the basket may be withdrawn from the inner case by a maximum withdrawal amount, a supporter assembly connected to the basket, the supporter assembly being configured to guide the basket during insertion and withdrawal, and a cover connected to the supporter assembly and interlocked with the basket, the cover being configured to cover the receiving space, and the cover being movable in a direction opposite to a movement of the basket when the basket may be inserted or withdrawn. The supporter assembly may include a supporter connected to the basket to support the basket and a transmission assembly installed in the supporter and configured to transmit a movement force of the basket to the cover. The basket may include a transmission protrusion configured to engage with the transmission assembly.

The transmission assembly may include a connection member engaged with the transmission protrusion of the basket and having a notch configured to receive the transmission protrusion of the basket so that the connection member moves together with the transmission protrusion to transmit the movement force of the basket to the cover. The transmission protrusion may be configured to be disengaged from the notch of the connection member so as to prevent the movement force of the basket to the cover when the basket may be withdrawn by a distance greater than a predetermined distance from the first position, the predetermined distance being less than a distance between the first and second positions.

When the cover is provided at a position such that the receiving space is opened, the basket may be withdrawn by the predetermined distance from the first position.

The transmission assembly may further include a first gear to which the connection member may be rotatably connected, a second gear engaged with the first gear, and a third gear engaged with the second gear and coupled to the cover.

The transmission assembly may be configured to transmit the movement force of the basket to the cover when the basket is withdrawn within a first range of positions between the first position and a third position. The transmission assembly may be configured to prevent the movement force of the basket to the cover when the basket may be withdrawn within a second range of positions between the third position and the second position.

The connection member may further include a front body and a rear body spaced apart from the front body. The notch may be positioned between the front body and the rear body.

The supporter may further include a guide slot to guide a movement of the connection member. The guide slot may include a first slot configured to guide a linear movement of the connection member and a second slot bent from an end of the first slot and configured to guide a rotation of the connection member.

The connection member may further include a lower body forming a bottom of the notch, a first protrusion provided on the lower body, and a second protrusion provided on the lower body and spaced apart from the first protrusion. The first protrusion and the second protrusion may be provided in the first slot when the basket may be in the first position.

When the basket is withdrawn by a distance larger than the predetermined distance, the connection member may be rotated, and the second protrusion may be provided in the second slot.

The connection member may be rotatably coupled to a central portion of the first gear. The first gear may include a plurality of teeth configured to engage with the second gear and a coupling body to which the coupling member may be coupled, the coupling body being provided at a central portion of the first gear.

A height of the front body may be less than a height of the rear body so that an upper end of the front body may be positioned lower than upper end of the rear body.

When the connection member is rotated in a first direction, the height of the front body of the connection member may be lowered so as not to interfere with a movement of the transmission protrusion. When the connection member is rotated in the first direction, the rear body may be located on the moving path of the transmission protrusion.

When the connection member is rotated in a second direction opposite to the first direction and the transmission protrusion pushes the rear body backward, the transmission protrusion may be positioned in the notch.

The basket may include a first roller installed on a side wall of the basket. The supporter may include a guide rail that forms a groove configured to receive the first roller. The guide rail may include a first guide rail configured to support the first roller, and a second guide rail positioned above the first guide rail and forming the groove together with the first guide rail. The first guide rail may include a first inclined surface which may be inclined downward to allow the basket to be lowered when the basket is moved to the first position.

A lower surface of the transmission protrusion may be positioned to be lower than an upper end of the front body when the transmission protrusion is lifted.

When the basket is provided at the first position, the transmission protrusion and the connection member may be positioned behind a rotation axis of the second gear.

When the basket is provided at the first position, a center of gravity of the basket and a center of gravity of the cover may be positioned in front of the rotation axis of the second gear.

When the cover is provided at a position such that the receiving space is opened, the basket is provided between the first and second positions, and a center of gravity of the cover may be provided behind a rotation axis of the second gear.

Embodiments disclosed herein may be implemented as a drawer assembly for an appliance including a basket configured to be moved between a first position and a second position, a supporter connected to the basket to support the basket, a lid configured to open or close the basket, the lid being movable in a direction opposite to a movement of the basket, a transmission protrusion provided at a side of the basket, and a connection hook having a notch and installed in the supporter. The notch may be configured to receive the transmission protrusion of the basket such that the connection hook transmits a movement force of the basket to the lid. The transmission protrusion may be disengaged from the notch to prevent the movement force of the basket to the lid when the basket is moved from the first position by a distance greater than a predetermined distance from the first position, the predetermined distance being less than a distance between the first and second positions.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a cabinet including an inner case; and a drawer assembly provided in the inner case, wherein the drawer assembly includes:

a basket which forms a receiving space and is configured to be inserted into or withdrawn from the inner case to be movable between a first position and a second position, the first position being a position where the basket is inserted into the inner case by a maximum insertion amount, and the second position being a position where the basket is withdrawn from the inner case by a maximum withdrawal amount;

a supporter assembly connected to the basket, the supporter assembly being configured to guide the basket during insertion and withdrawal; and a cover connected to the supporter assembly and interlocked with the basket, the cover being configured to cover the receiving space, and the cover being movable in a direction opposite to a movement of the basket when the basket is inserted or withdrawn, wherein the supporter assembly includes:

a supporter connected to the basket to support the basket; and a transmission assembly installed in the supporter and configured to transmit a movement force of the basket to the cover, wherein the basket includes a transmission protrusion configured to engage with the transmission assembly, and the transmission assembly includes a connection member engaged with the transmission protrusion of the basket and having a notch configured to receive the transmission protrusion of the basket, wherein the connection member is rotatably coupled to a first gear, and wherein the transmission protrusion is configured to be disengaged from the notch of the connection member when the basket is withdrawn by a distance greater than a predetermined distance from the first position, the predetermined distance being less than a distance between the first and second positions.

2. The refrigerator of claim 1, wherein, when the cover is provided at a position such that the receiving space is opened, the basket is withdrawn by the predetermined distance from the first position.

3. The refrigerator of claim 1, wherein the transmission assembly further includes:

a second gear engaged with the first gear; and a third gear engaged with the second gear and coupled to the cover.

4. The refrigerator of claim 3, wherein the transmission assembly is configured to transmit the movement force of the basket to the cover when the basket is withdrawn within a first range of positions between the first position and a third position, and the transmission assembly is configured to prevent the movement force of the basket to the cover when the basket is withdrawn within a second range of positions between the third position and the second position.

5. The refrigerator of claim 3, wherein the connection member further includes:

a front body; and a rear body spaced apart from the front body; wherein the notch is positioned between the front body and the rear body.

6. The refrigerator of claim 5, wherein the supporter further includes a guide slot to guide a movement of the connection member, and the guide slot includes:

a first slot configured to guide a linear movement of the connection member; and a second slot bent from an end of the first slot and configured to guide a rotation of the connection member.

7. The refrigerator of claim 6, wherein the connection member further includes:

a lower body forming a bottom of the notch;

a first protrusion provided on the lower body; and a second protrusion provided on the lower body and spaced apart from the first protrusion, wherein the first protrusion and the second protrusion are provided in the first slot when the basket is in the first position.

8. The refrigerator of claim 7, wherein, when the basket is withdrawn by a distance larger than the predetermined distance, the connection member is rotated and the second protrusion is provided in the second slot.

9. The refrigerator of claim 5, wherein a height of the front body is less than a height of the rear body so that an upper end of the front body is positioned lower than upper end of the rear body.

10. The refrigerator of claim 9, wherein, when the connection member is rotated in a first direction, the height of the front body of the connection member is lowered so as not to interfere with a movement of the transmission protrusion.

11. The refrigerator of claim 10, wherein, when the connection member is rotated in the first direction, the rear body is located on the moving path of the transmission protrusion.

12. The refrigerator of claim 11, wherein, when the connection member is rotated in a second direction opposite to the first direction and the transmission protrusion pushes the rear body backward, the transmission protrusion is positioned in the notch.

13. The refrigerator of claim 5, wherein the basket includes a first roller installed on a side wall of the basket, the supporter includes a guide rail that forms a groove configured to receive the first roller, and the guide rail includes:

a first guide rail configured to support the first roller; and a second guide rail positioned above the first guide rail and forming the groove together with the first guide rail, wherein the first guide rail includes a first inclined surface which is inclined downward to allow the basket to be lowered when the basket is moved to the first position.

14. The refrigerator of claim 13, wherein a lower surface of the transmission protrusion is positioned to be lower than an upper end of the front body when the transmission protrusion is lifted.

15. The refrigerator of claim 3, wherein, when the basket is provided at the first position, the transmission protrusion and the connection member are positioned behind a rotation axis of the second gear.

16. The refrigerator of claim 15, wherein, when the basket is provided at the first position, a center of gravity of the basket and a center of gravity of the cover are positioned in front of the rotation axis of the second gear.

17. The refrigerator of claim 3, wherein, when the cover is provided at a position such that the receiving space is opened, the basket is provided between the first and second positions, and a center of gravity of the cover is provided behind a rotation axis of the second gear.

18. The refrigerator of claim 1, wherein the first gear includes a plurality of teeth configured to engage with the second gear and a coupling body to which the coupling member is coupled, the coupling body being provided at a central portion of the first gear.

* * * * *